US010333216B2

(12) United States Patent
Kim

(10) Patent No.: US 10,333,216 B2
(45) Date of Patent: Jun. 25, 2019

(54) ANTENNA APPARATUS AND VEHICLE HAVING THE SAME

(71) Applicant: Hyundai Motor Company, Seoul (KR)

(72) Inventor: Dongjin Kim, Seoul (KR)

(73) Assignee: Hyundai Motor Company, Seoul (KR)

( * ) Notice: Subject to any disclaimer, the term of this patent is extended or adjusted under 35 U.S.C. 154(b) by 396 days.

(21) Appl. No.: 15/163,388

(22) Filed: May 24, 2016

(65) Prior Publication Data

US 2017/0149130 A1 May 25, 2017

(30) Foreign Application Priority Data

Nov. 24, 2015 (KR) ..... 10-2015-0164886

(51) Int. Cl.

| | |
|---|---|
| ***H01Q 3/12*** | (2006.01) |
| ***H01Q 3/24*** | (2006.01) |
| ***H01Q 13/12*** | (2006.01) |
| ***H01Q 21/00*** | (2006.01) |
| *H01Q 1/32* | (2006.01) |

(52) U.S. Cl.

CPC ..... *H01Q 3/24* (2013.01); *H01Q 13/12* (2013.01); *H01Q 21/0056* (2013.01); *H01Q 1/3275* (2013.01)

(58) Field of Classification Search

CPC ..... H01Q 3/24; H01Q 1/3275; H01Q 3/12; H01Q 21/0056

USPC ..... 342/79, 359, 372, 374; 343/762, 771, 343/798

See application file for complete search history.

(56) References Cited

U.S. PATENT DOCUMENTS

| | | | | |
|---|---|---|---|---|
| 8,427,384 B2 * | 4/2013 | Clymer | ..... | H01Q 1/185 343/776 |
| 2005/0093733 A1 * | 5/2005 | Lovberg | ..... | G01V 8/005 342/22 |

FOREIGN PATENT DOCUMENTS

| | | | |
|---|---|---|---|
| JP | 10-2004-508749 | A | 3/2004 |
| JP | 2012-159349 | A | 8/2012 |
| KR | 10-2004-0038834 | A | 5/2004 |
| KR | 10-2004-0100328 | | 12/2004 |
| KR | 10-2008-0051453 | | 6/2008 |
| KR | 10-2015-0045303 | | 4/2015 |
| KR | 10-2015-0078535 | | 7/2015 |
| WO | 2010/050122 | A1 | 5/2010 |

* cited by examiner

*Primary Examiner* — Dao L Phan

(74) *Attorney, Agent, or Firm* — Brinks Gilson & Lione

(57) ABSTRACT

Disclosed herein is an antenna apparatus which allows adjusting a directional pattern to a desired direction through a simple switching without employing a complicated feed structure of an array antenna and a vehicle having the same. The antenna apparatus includes a power feed unit, a waveguide through which a radio signal provided from the power feed unit propagates, a plurality of antenna elements including radiation slots from which the radio signal propagating through the waveguide is radiated and configured to be shifted by a predetermined angle and stacked, and a switching unit configured to switch at least one of the power feed units included in the plurality of antenna elements in order to select at least one of the plurality of antenna elements.

22 Claims, 25 Drawing Sheets

ANTENNA APPARATUS AND VEHICLE HAVING THE SAME

CROSS-REFERENCE TO RELATED APPLICATION

This application claims the benefit of Korean Patent Application No. 10-2015-0164886, filed on Nov. 24, 2015 in the Korean Intellectual Property Office, the entire disclosure of which is incorporated herein by reference.

BACKGROUND

1. Field

Forms of the present disclosure relate to an antenna apparatus capable of adjusting a directional pattern and a vehicle having the same.

2. Description of the Related Art

When a position of a communication target is varied or a scanning is needed for searching a position of the communication target, it is required to adjust a directional pattern of an antenna.

In general, a directional pattern of an antenna is adjusted by altering a phase difference between array radiation elements to control a direction of main beam or by using a mechanical rotation.

However, in the case of altering the phase difference, a plurality of additional circuits for controlling a phase of each array radiation element are required, an angle of a pattern alteration is small, and a large side lobe is generated, thus reducing the radiation efficiency of an antenna.

Furthermore, in the case of using the mechanical rotation, a separate structure for rotating the antenna is required, and it is difficult to accurately adjust a directional pattern in a direction of a communication target traveling at a high speed.

SUMMARY

Therefore, it is an aspect of the present disclosure to provide an antenna apparatus capable of adjusting a directional pattern toward a desired direction through a simple switching without employing a complicated feed configuration of an array antenna and a vehicle having the same.

In one form of the present disclosure, an antenna apparatus includes a power feed unit, a waveguide through which a radio signal provided from the power feed unit propagates, and a plurality of antenna elements including radiation slots for radiating the radio signal propagated through the waveguide, and the plurality of antenna elements are shifted by a predetermined angle and stacked.

The antenna apparatus may further include a switching unit for switching at least one of the power feed units included in the plurality of antenna elements in order to select at least one of the plurality of antenna elements.

The plurality of antenna elements may be formed by a plurality of substrates that are stacked in up and down directions.

The antenna element may include an upper plate, a lower plate, and n partition walls (n is an integer equal to or greater than 2) that is formed between the upper and lower plates to form n−1 number of waveguides.

The upper and lower plates may be each formed in predetermined regions of two adjacent substrates of the plurality of substrates.

The partition wall may be formed with a plurality of pins adjacent to each other spaced at a distance below a critical distance, and the plurality of pins may be inserted into the upper and lower plates.

The n−1 number of waveguides may distribute the radio signal provided from the power feed units in the same phase and amplitude.

Between the power feed units and the n−1 number of waveguides, n−1 number of inductive posts may be arranged.

A common ground unit to which the power feed units included in the plurality of antenna elements are connected may be further included.

The plurality of antenna elements may be stacked one per layer.

The plurality of antenna elements may be stacked two or more per layer.

In another form of the present disclosure, a vehicle is equipped with an antenna apparatus, wherein the antenna apparatus includes a power feed unit, a waveguide through which a radio signal provided from the power feed unit propagates, and a plurality of antenna elements including radiation slots for radiating the radio signal propagated through the waveguide and shifted by a predetermined angle and stacked.

The antenna apparatus may further include a switching unit for selecting at least one of the power feed units included in the plurality of antenna elements.

The plurality of antenna elements may be formed by a plurality of substrates that are stacked in upward and downward directions.

The antenna element may include an upper plate, a lower plate, and n partition walls (n is an integer equal to or greater than 2) that is formed between the upper and lower plates to form n−1 number of waveguides.

The upper and lower plates may be each formed on certain regions of two adjacent substrates of the plurality of substrates.

The partition wall may be formed with a plurality of pins adjacent to each other spaced at a distance below a critical distance, and the plurality of pins may be inserted into the upper and lower plates.

The n−1 number of waveguides may distribute the radio signals provided from the power feed units in the same phase and amplitude.

Between the power feed units and the n−1 number of waveguides, n−1 number of inductive posts may be arranged.

A common ground unit to which the power feed units included in the plurality of antenna elements are connected may be further included.

The switching unit may sequentially switch the power feed units in order to determine a position of a communication target.

The switching unit may switch the power feed unit of the antenna element corresponding to the position of the communication target.

The switching unit may switch the power feed unit according to the movement of the communication target to perform a beam tracking when the communication target moves.

The switching unit may switch the power feed unit according to the movement of the vehicle to perform the beam tracking when the vehicle moves.

In forms of the present disclosure, an antenna apparatus and a vehicle having the same may adjust a directional pattern toward a desired direction through a simple switching without employing a complicated feed configuration of an array antenna.

Also, it is possible to alter a directional pattern within a desired angle range by adjusting numbers of the antenna elements.

BRIEF DESCRIPTION OF THE DRAWINGS

These and/or other aspects of the disclosure will become apparent and more readily appreciated from the following description of the forms, taken in conjunction with the accompanying drawings of which.

DETAILED DESCRIPTION

Hereinafter, forms of the present disclosure will be described in detail with reference to the accompanying drawings.

Figure 1:
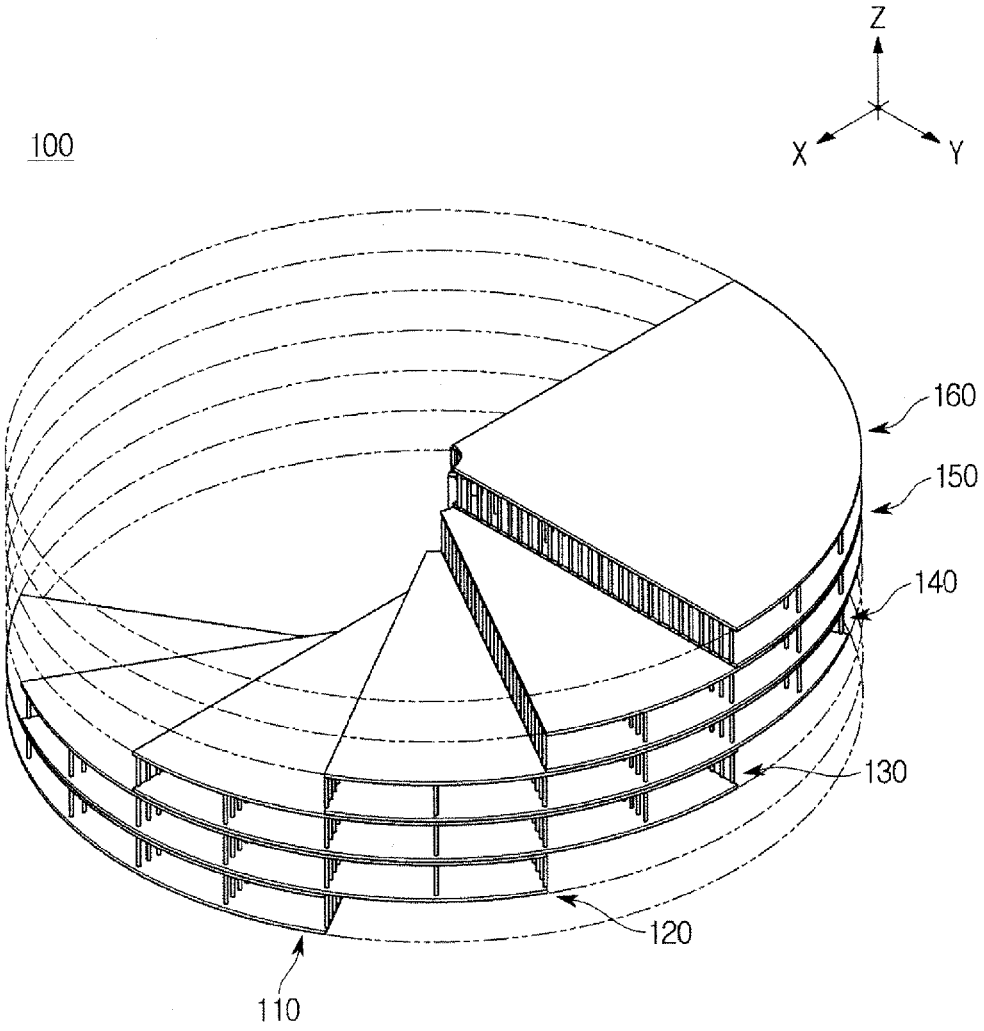
FIG. 1 is a perspective view illustrating a structure of an antenna apparatus.
Figure 2:
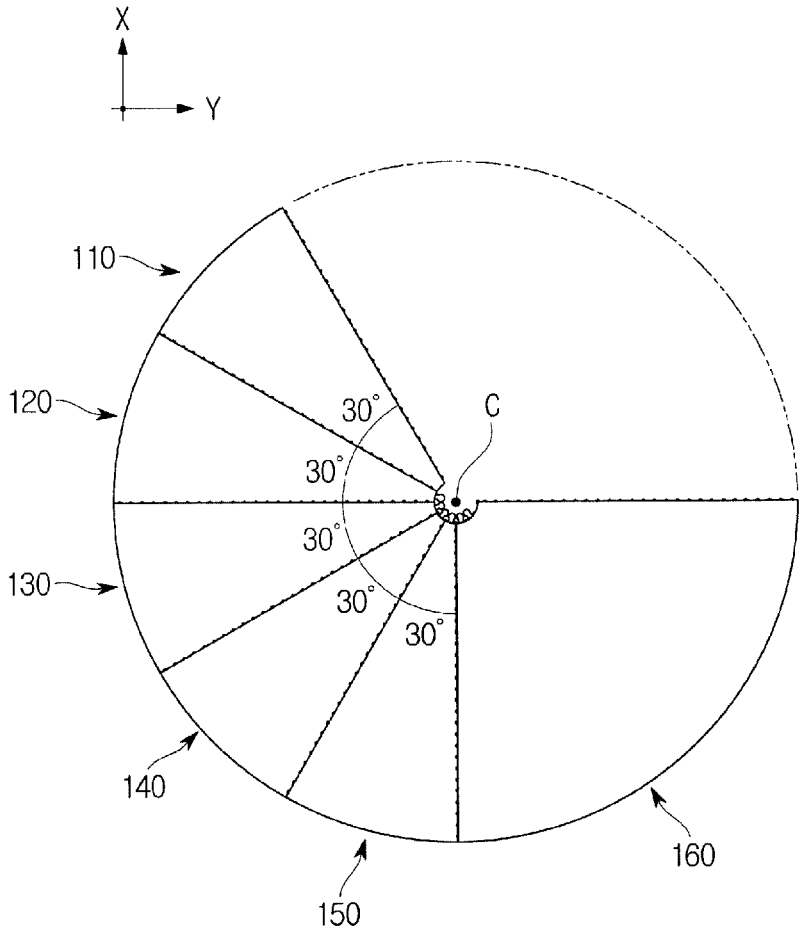
FIG. 2 is a plan view of the antenna apparatus as viewed from above.

FIG. 1 is a perspective view illustrating a structure of an antenna apparatus, and FIG. 2 is a plan view of the antenna apparatus as viewed from above. The following forms will be described with a z-axis direction regarded as the up and down directions. Therefore, the perspective view of FIG. 1 is a view in a three-dimensional space defined by x-, y-, z-axis directions, whereas FIG. 2 is a two-dimensional view in an x-y plane.

An antenna apparatus 100 has an array antenna structure in which a plurality of antenna elements are arranged. As shown in FIG. 1, a plurality of antenna elements 110, 120, 130, 140, 150, and 160 constituting the antenna apparatus 100 are stacked in the z-axis direction, that is, up and down directions.

In the example of FIGS. 1 and 2, each antenna element has a fan shape, and the antenna apparatus 100 formed by stacking the plurality of antenna elements has a circular column shape. However, this is merely an example of the antenna apparatus 100, and each antenna element may have other shapes such as a polygonal shape, a circular shape, a semicircular shape, and the like besides the fan shape. Also, the antenna apparatus 100 may have other shapes such as a polygonal column shape besides the circular column shape. For the purpose of explaining a detailed structure, the following forms will be described with examples where each antenna element has the fan shape and the antenna apparatus 100 has the circular column shape.

As shown in FIG. 2, the plurality of antenna elements 110, 120, 130, 140, 150, and 160 are stacked with each shifted by a predetermined angle instead of being stacked lined up in the z-axis direction. Each antenna element is shifted by a predetermined angle so that a direction of radiation or beam pattern of the antenna apparatus 100 may be variably adjusted. Hereinafter, the example will be described in detail.

For example, when the first antenna element 110, the second antenna element 120, the third antenna element 130, the fourth antenna element 140, the fifth antenna element 150, and the sixth antenna element 160 are sequentially stacked from the bottom, the second antenna element 120 may be shifted by 30 degrees in a counterclockwise direction from the first antenna element 110 about the center C in a x-y plane of the antenna apparatus 100, the third antenna element 130 may be shifted by 30 degrees in a counterclockwise direction from the second antenna element 120, the fourth antenna element 140 may be shifted by 30 degrees in a counterclockwise direction from the third antenna element 130, the fifth antenna element 150 may be shifted by 30 degrees in a counterclockwise direction from the fourth antenna element 140, and the sixth antenna element 160 may be shifted by 30 degrees in a counterclockwise direction from the fifth antenna element 150.

In this case, the antenna apparatus 100 may switch a radiation direction within the range of 180 degrees. For example, when the antenna elements 110, 120, 130, 140, 150, and 160 each has a radiation range of 90 degrees, the antenna apparatus 100 may cover a range of about 240 degrees and selectively radiate a radio signal in a desired direction within the range of 240 degrees. Also, by variously changing a design regarding a radiation range of each antenna element, shift angles among the antenna elements, and a number of antenna elements, a coverage of the antenna apparatus 100 may be adjusted.

FIGS. 3 to 6 are diagrams illustrating a structure of a single antenna element constituting the antenna apparatus. In the examples in FIGS. 3 to 6, a structure of a first antenna element arranged in the lowest layer is described.

Figure 3:
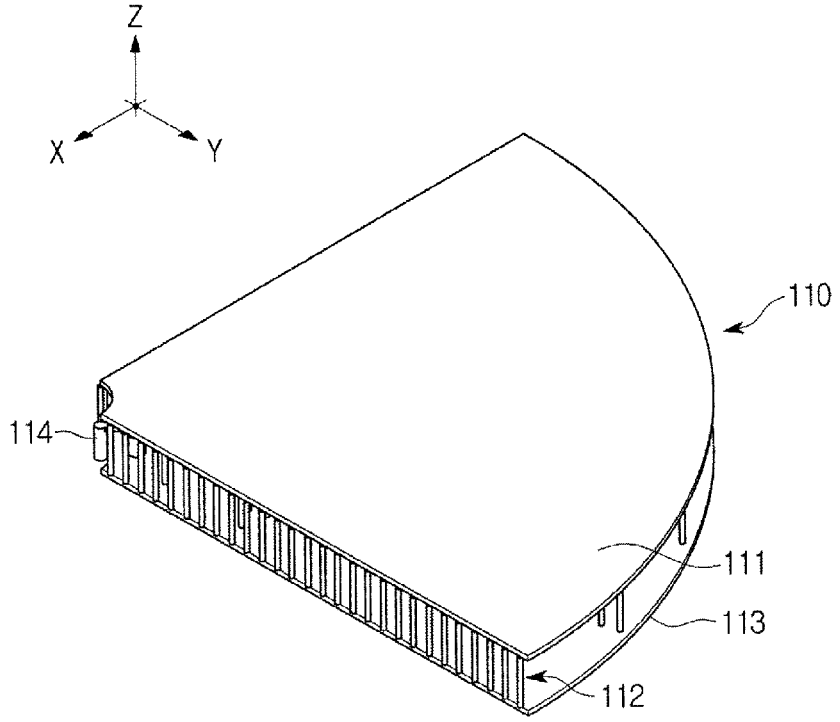
FIGS. 3 to 7 are diagrams illustrating a structure of a single antenna element constituting the antenna apparatus.

With reference to FIG. 3, the first antenna element 110 includes an upper plate 111 and a lower plate 113 having a fan shape and a partition wall 112 for partitioning multiple waveguides 115 in the antenna element.

A power feed unit 114 is connected to the center of the fan shape and a radio signal provided from the power feed unit 114 is radiated into outside free space through the first antenna element 110.

Figure 4:
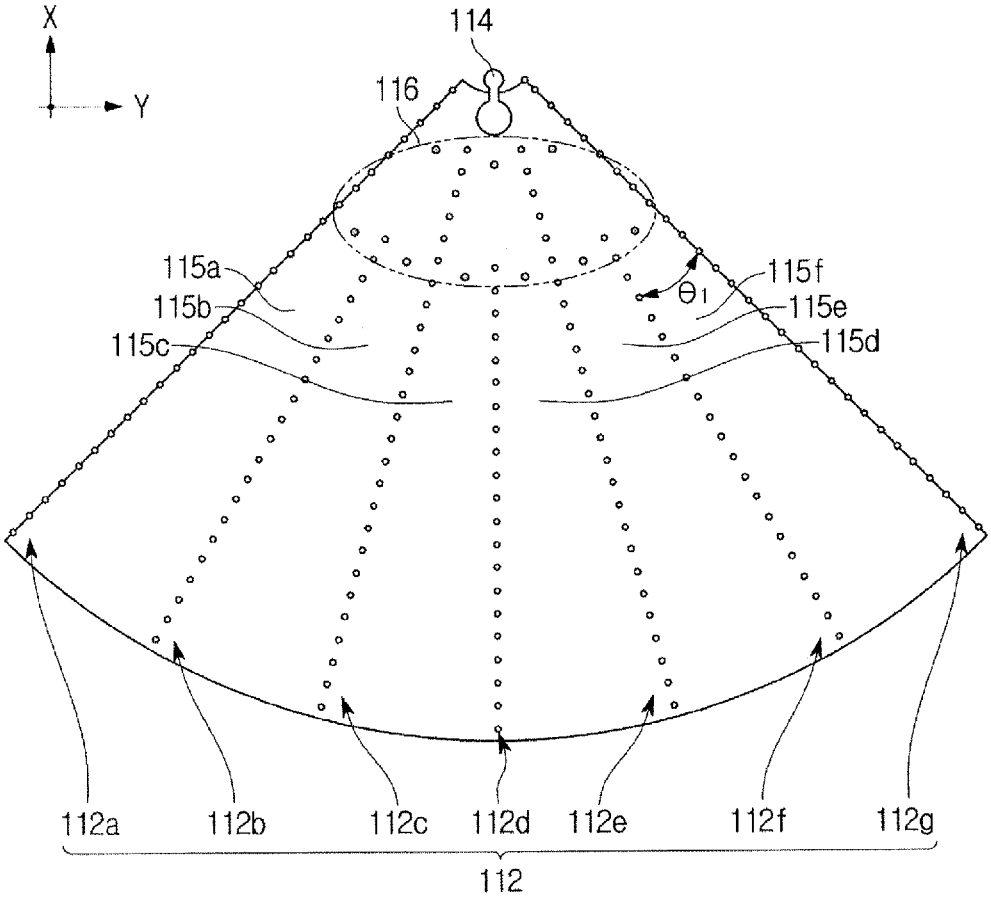
Figure 5:
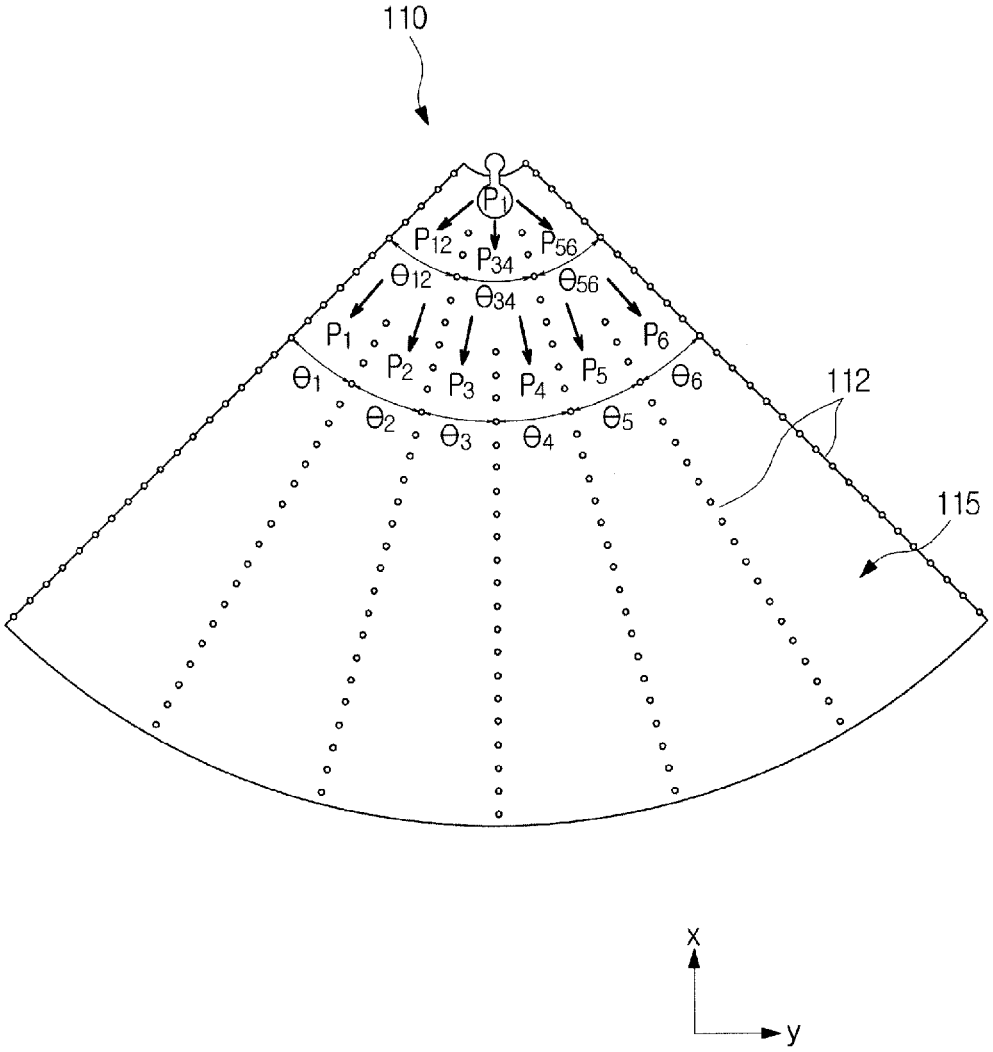
Figure 6:
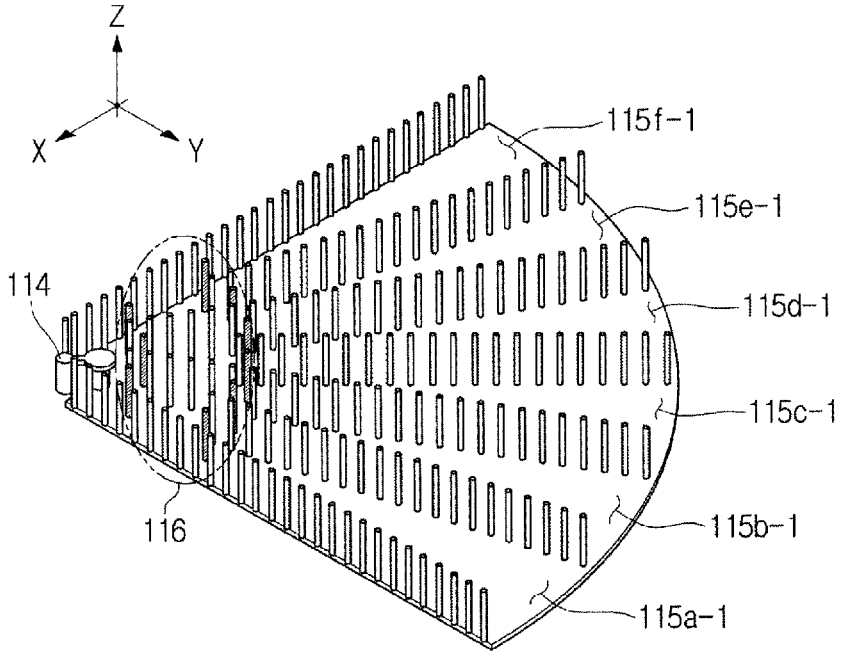

In order to illustrate an internal structure of the first antenna element 110 in detail, the upper plate 111 is not shown in FIGS. 4 to 6.

Figure 7:
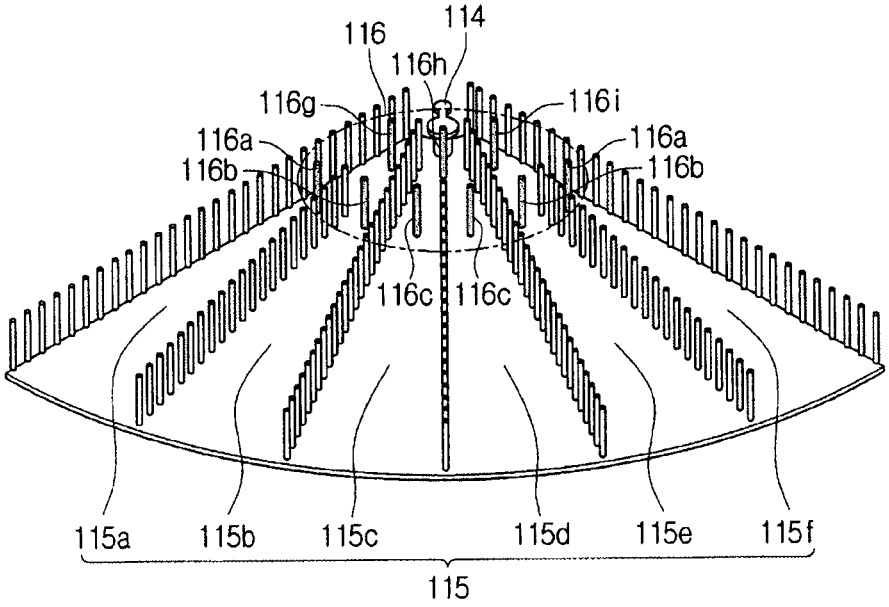

FIG. 4 is a plan view of the first antenna element as viewed from above, FIG. 5 is a diagram illustrating a distribution of power provided from the power feed unit, and FIGS. 6 and 7 are a plan view and a perspective view, respectively, illustrating the antenna element further including inductive posts.

For example, as shown in FIG. 4, when six waveguides are formed in the single antenna element, the partition wall 112 partitioning the waveguides 115*a*, 115*b*, 115*c*, 115*d*, 115*e*, and 115*f* may be formed as seven partition walls ranging from first to seventh partition walls 112*a*, 112*b*, 112*c*, 112*d*, 112*e*, 112*f*, and 112*g*.

The first waveguide 115*a* may be partitioned by the first partition wall 112*a* and the second partition wall 112*b*, the second waveguide 115*b* may be partitioned by the second partition wall 112*b* and the third partition wall 112*c*, and the third waveguide 115*c* may be partitioned by the third partition wall 112*c* and the fourth partition wall 112*d*. Also, the fourth waveguide 115*d* may be partitioned by the fourth partition wall 112*d* and the fifth partition wall 112*e*, the fifth waveguide 115*e* may be partitioned by the fifth partition wall 112*e* and the sixth partition wall 112*f*, and the sixth waveguide 115*f* may be partitioned by the sixth partition wall 112*f* and the seventh partition wall 112*g*.

In the example form, the partition wall 112 may be implemented by multiple pins each arranged with a constant spacing or implemented in a general plate shape. When the partition wall 112 is implemented by the multiple pins, it is possible to implement the partition wall 112 by inserting the multiple pins into the upper plate 111 and the lower plate 113, so that an ease of manufacturing and design may be improved.

When the partition wall 112 is implemented by the multiple pins, by limiting a spacing between the adjacent pins to be below a critical distance, a loss of a radio signal propagating through the waveguide 115 may be prevented. For example, it is possible to prevent the loss by arranging the multiple pins at a spacing equal to or less than one-tenth of the wavelength of the radio signal.

The radio signal provided from the power feed unit 114 is branched off to propagate through the six waveguides 115*a*, 115*b*, 115*c*, 115*d*, 115*e*, and 115*f*, and then the branched-off radio signals are radiated into the outside free space through radiation slots 115*a*-1, 115*b*-1, 115*c*-1, 115*d*-1, 115*e*-1, and 115*f*-1 formed respectively on each of the corresponding waveguides.

Meanwhile, when the radio signal provided from the power feed unit 114 is branched off, power of the radio signal is distributed. In the example form, the structure of the partition wall 112 may perform a function of a power divider. Hereinafter, with reference to FIG. 5, the branching of the radio signal will be described in terms of power distribution.

As shown in FIG. 5, by adjusting a length of the partition wall 112 forming each waveguide, the power provided from the power feed unit 114 may be distributed in steps.

For example, as shown in FIG. 5, lengths of the second partition wall 112*b* being the boundary between the first waveguide 115*a* and the second waveguide 115*b*, the fourth partition wall 112*d* being the boundary between the third waveguide 115*c* and the fourth waveguide 115*d*, and the sixth partition wall 112*f* being the boundary between the fifth waveguide 115*e* and the sixth waveguide 115*f* may be implemented shorter than those of the remaining partition walls. The length of the partition wall represents a length from one end of the partition wall near the power feed unit 114 to the opposite end, and when a shape of the single antenna element is a fan shape, the length of the partition wall represents a length in a radial direction.

A forward direction of the power feed unit 114 is a direction at which the power or radio signal is distributed, and a backward direction thereof is a direction toward the center of the fan-shaped antenna.

The third partition wall 112*c* and the fifth partition wall 112*e* may be implemented longer than the second partition wall 112*b*, the fourth partition wall 112*d*, and the sixth partition wall 112*f* and shorter than the first partition wall 112*a* and the seventh partition wall 112*g*.

When the first antenna element 110 has a structure made of the aforementioned partition walls, power $P_1$ provided from the power feed unit 114 is distributed into a space between the first partition wall 112*a* and the third partition wall 112*c*, a space between the third partition wall 112*c* and the fifth partition wall 112*e*, and a space between the fifth partition wall 112*e* and the seventh partition wall 112*g*, so that the distributed powers are $P_{12}$, $P_{34}$, and $P_{56}$, respectively.

In order to make the distributed power $P_{12}$, $P_{34}$, and $P_{56}$ have the same value, an angle $\theta_{12}$ between the first partition wall 112*a* and the third partition wall 112*c*, an angle $\theta_{34}$ between the third partition wall 112*c* and the fifth partition wall 112*e*, and an angle $\theta_{56}$ between the fifth partition wall 112*e* and the seventh partition wall 112*g* are all designed to have the same value.

That is, in order to satisfy $P_{12}=P_{34}=P_{56}$, $\theta_{12}=\theta_{34}=\theta_{56}$ should be satisfied. Also, the provided power $P_1$ is distributed into three equal values of power so that the relationship of $P_1=3P_{12}=3P_{34}=3P_{56}$ is established.

The power $P_{12}$ distributed into the space between the first partition wall 112*a* and the third partition wall 112*c* is again distributed into a space between the first partition wall 112*a* and the second partition wall 112*b* and a space between the second partition wall 112*b* and the third partition wall 112*c*, that is, distributed into the first waveguide 115*a* and the second waveguide 115*b*. At this point, the distributed power values are $P_1$ and $P_2$ respectively.

The power $P_{34}$ distributed into the space between the third partition wall 112*c* and the fifth partition wall 112*e* is again distributed into a space between the third partition wall 112*c* and the fourth partition wall 112*d* and a space between the fourth partition wall 112*d* and the fifth partition wall 112*e*, that is, distributed into the third waveguide 115*c* and the fourth waveguide 115*d*. At this point, the distributed power values are $P_3$ and $P_4$ respectively.

The power $P_{56}$ distributed into the space between the fifth partition wall 112*e* and the seventh partition wall 112*g* is again distributed into a space between the fifth partition wall 112*e* and the sixth partition wall 112*f* and a space between the sixth partition wall 112*f* and the seventh partition wall 112*g*, that is, distributed into the fifth waveguide 115*e* and the sixth waveguide 115*f*. At this point, the distributed power values are $P_5$ and $P_6$ respectively.

Similarly, in order to make the power distributed into each of the waveguides have the same value, an angle $\theta_1$ between the first partition wall 112*a* and the second partition wall 112*b*, an angle $\theta_2$ between the second partition wall 112*b* and the third partition wall 112*c*, an angle $\theta_3$ between the third partition wall 112*c* and the fourth partition wall 112*d*, an angle $\theta_4$ between the fourth partition wall 112*d* and the fifth partition wall 112*e*, an angle $\theta_5$ between the fifth partition wall 112*e* and the sixth partition wall 112*f*, and an angle $\theta_6$ between the sixth partition wall 112*f* and the seventh partition wall 112*g* are designed to have the same value. That is, $\theta_{12}=2\theta_1=2\theta_2$, $\theta_{34}=2\theta_3=2\theta_4$, and $\theta_{56}=2\theta_5=2\theta_6$.θ

As a result, the relationship of $P_1=3P_{12}=3P_{34}=3P_{56}=6P_1=6P_2=6P_3=6P_4=6P_5=6P_6$ is established. That is, the same power value may be distributed to each of the waveguides, and the radio signals having the same phase and amplitude may be branched off to be radiated through the radiation slots.

For example, when the first antenna element 110 has a radiation range of 90 degrees, it may be $\theta_{12}=\theta_{34}=\theta_{56}=30$ degrees, and $\theta_1=\theta_2=\theta_3=\theta_4=\theta_5=\theta_6=15$ degrees.

Meanwhile, distributing the power through the partition wall structure described above is merely an example applicable to the antenna apparatus 100, and various modifications in which the procedures for power distribution is further subdivided, the power is distributed in six ways at once, and the number of waveguides is decreased or increased from six are definitely possible.

FIGS. 6 and 7 are diagrams illustrating a power feed structure further including inductive posts.

With reference to FIGS. 6 and 7, in order to improve a return loss, inductive posts 116 are further included in the first antenna element 110. The inductive post may be implemented by a metal fin.

When the power distribution is performed as in the example described above, three inductive posts 116*g*, 116*h*, and 116*i* may be firstly arranged in positions close to the power feed unit 114, and then six inductive posts 116*a*, 116*b*, 116*c*, 116*d*, 116*e*, and 116*f* corresponding to the waveguides may be arranged.

In particular, the inductive posts 116*g*, 116*h*, and 116*i* may be arranged respectively in a space between the first partition wall 112*a* and the third partition wall 114*c*, a space between the third partition wall 114*c* and the fifth partition wall 114*e*, and a space between the fifth partition wall 114*e* and the seventh partition wall 114*g*.

And, the inductive posts 116*a*, 116*b*, 116*c*, 116*d*, 116*e*, and 116*f* may be arranged respectively in a space between the first partition wall 112*a* and the second partition wall 112*b*, a space between the second partition wall 112*b* and the third partition wall 112*c*, a space between the third partition wall 112*c* and the fourth partition wall 112*d*, a space between the fourth partition wall 112*d* and the fifth partition wall 112*e*, a space between the fifth partition wall 112*e* and the sixth partition wall 112*f*, and a space between the sixth partition wall 112*f* and the seventh partition wall 112*g*.

By arranging the inductive posts as described above, the return loss of the radio signal distributed into each space may be improved by about 20 percent (%).

The inductive post 116 may connect the upper plate 111 to the lower plate 113, and since a difference in inductive capacity occurs depending on a diameter of the inductive post 116, the diameter of the inductive post 116 may be determined by considering an amount of the return loss.

Also, a distance between the inductive post 116 and the power feed unit 114 may be determined depending on the center frequency of the radio signal.

Further, since a height of the power feed unit 114 also affects the amount of the return loss, it is possible to design the height so as to minimize the amount of the return loss. At this point, a height of the power feed unit 114 capable of minimizing the amount of the return loss may be determined by a simulation, an experiment, and/or a calculation.

Furthermore, when the inductive post 116 is arranged, capacitance between the upper plate 111 and the lower plate 113 is reduced to cause a variation of impedance, so a height of the power feed unit 114 may be appropriately adjusted according to the arrangement of the inductive post 116.

The structure of the first antenna element 110 shown in FIGS. 3 to 7 may be identically applicable to the remaining antenna elements 120, 130, 140, 150, and 160, so that a detailed description of the structure of each of the remaining antenna elements will be omitted.

Figure 8:
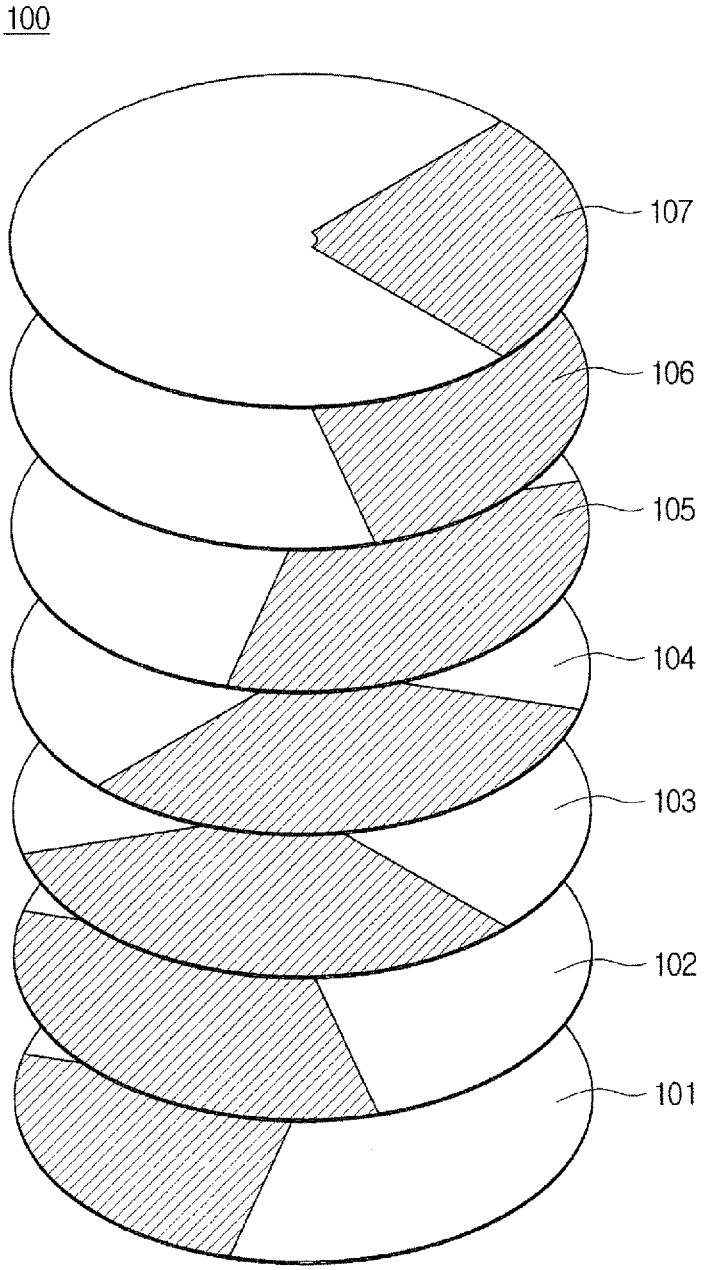
FIG. 8 is a diagram illustrating the example in which a plurality of antenna elements is stacked.

FIG. 8 is a diagram illustrating an example of which the plurality of antenna elements is stacked.

As described with reference to FIGS. 1 and 2, the antenna apparatus 100 has a structure in which the plurality of antenna elements 110, 120, 130, 140, 150, and 160 are stacked in the z-axis direction. For implementing such a structure, as shown in FIG. 8, multiple substrates 101, 102, 103, 104, 105, 106, and 107 may be stacked in the z-axis direction.

Each substrate may be formed by a conductor. For example, the substrate may be made of a metal such as copper, aluminum, lead, silver, and stainless steel, have a surface coated with these metals, or employ a printed circuit board (PCB). In case of employing the PCB, the structure of the antenna element may be formed by printing and via-holes.

As a detailed example, in order to form six antenna elements 110, 120, 130, 140, 150, and 160, seven PCB substrates 101, 102, 103, 104, 105, 106, and 107 may be stacked. At this point, in order to form the waveguides between the substrates, substrates adjacent to each other in the z-axis direction may be separated from each other at a constant spacing instead of contacting each other.

A spacing between the substrates may be determined depending on a frequency of the radio signal and, as an example, may be separated by 1 millimeter (mm) when the center frequency of the radio signal is 60 gigahertz (GHz). Also, a radius of the single antenna element may be implemented to be about 5 mm.

Meanwhile, the space between the substrates may be empty or filled with a dielectric substance.

The first antenna element 110 is formed by using the first substrate 101 and the second substrate 102. That is, a predetermined region of the first substrate 101 and a predetermined region of the second substrate 102 are respectively used as the upper plate 111 and the lower plate 113 of the first antenna element 110.

The second antenna element 120 is formed by using the second substrate 102 and the third substrate 103. Similarly, a predetermined region of the second substrate 102 and a predetermined region of the third substrate 103 may respectively be used as the upper and lower plates of the second antenna element 120.

Also, the third antenna element 130 may be formed by using the third substrate 103 and the fourth substrate 104, the fourth antenna element 140 may be formed by using the fourth substrate 104 and the fifth substrate 105, the fifth antenna element 150 may be formed by using the fifth substrate 105 and the sixth substrate 106, and the sixth antenna element 160 may be formed by using the sixth substrate 106 and the seventh substrate 107.

Meanwhile, a region of the substrate that is not used as the upper and lower plates may be made of a nonconductor. For example, the region that is used as the upper and lower plates may be coated with a metal such as gold, silver, copper or the like, whereas the coating may be removed from the other region.

In the drawings described above, the number of the substrates is merely an example applicable to the antenna apparatus 100, and the number of the antenna elements and the number of the substrates used depending on a stacking manner of the antenna elements may definitely be varied.

Figure 9:
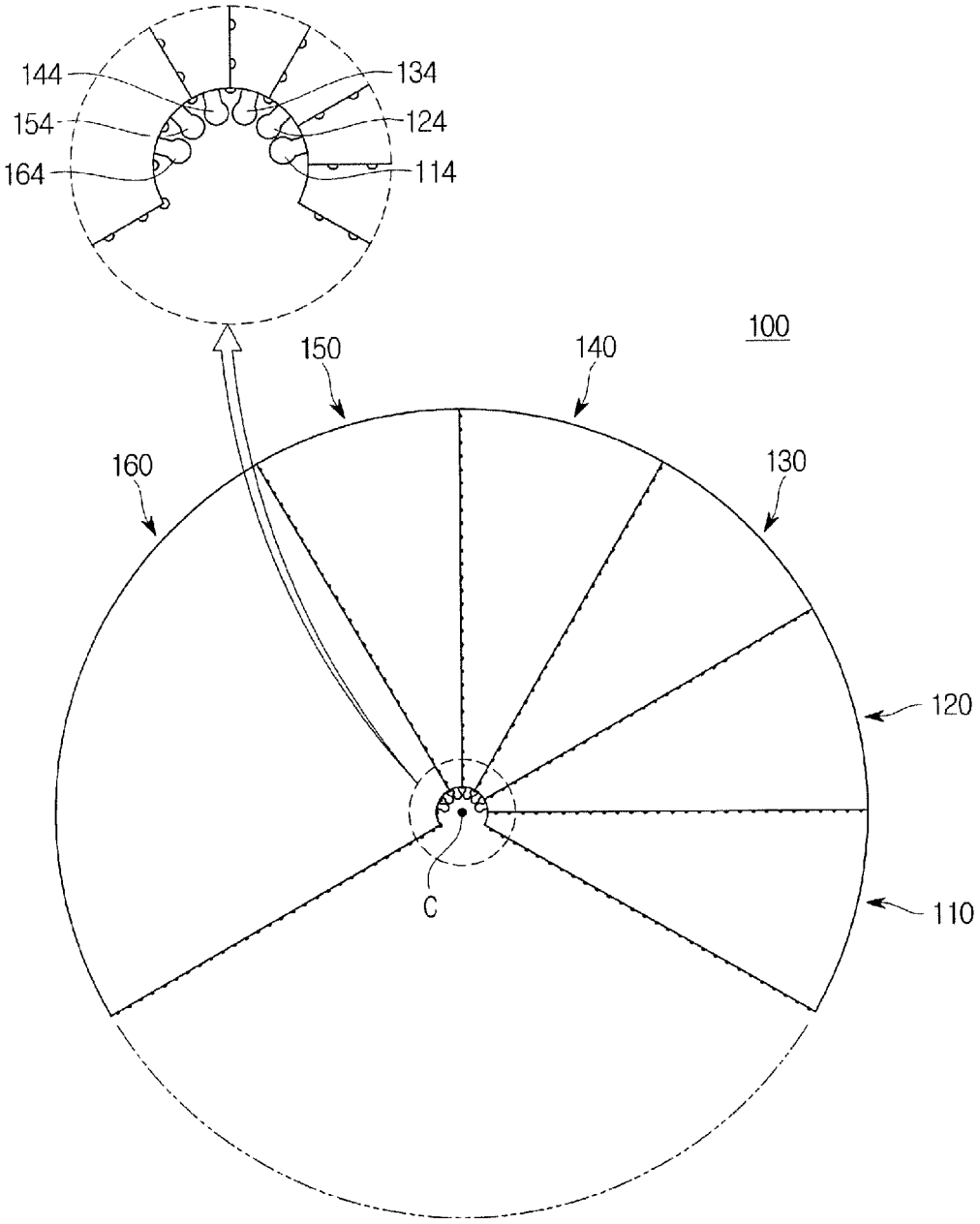
FIGS. 9 and 10 are diagrams illustrating a power feed unit providing power to each antenna element.
Figure 10:
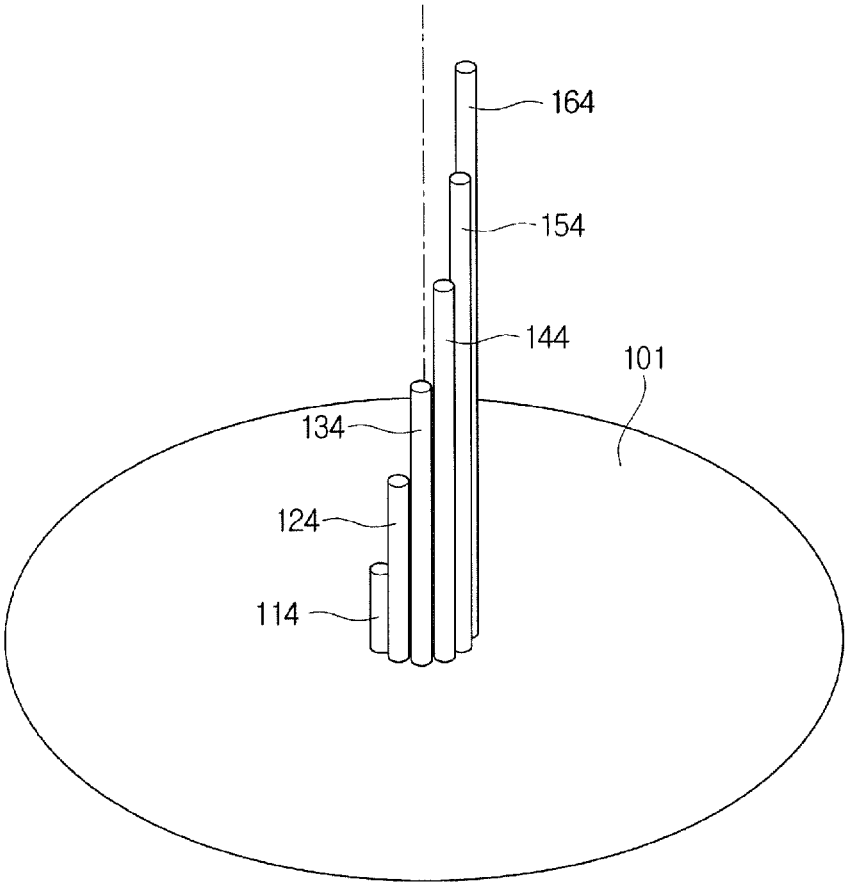
Figure 11:
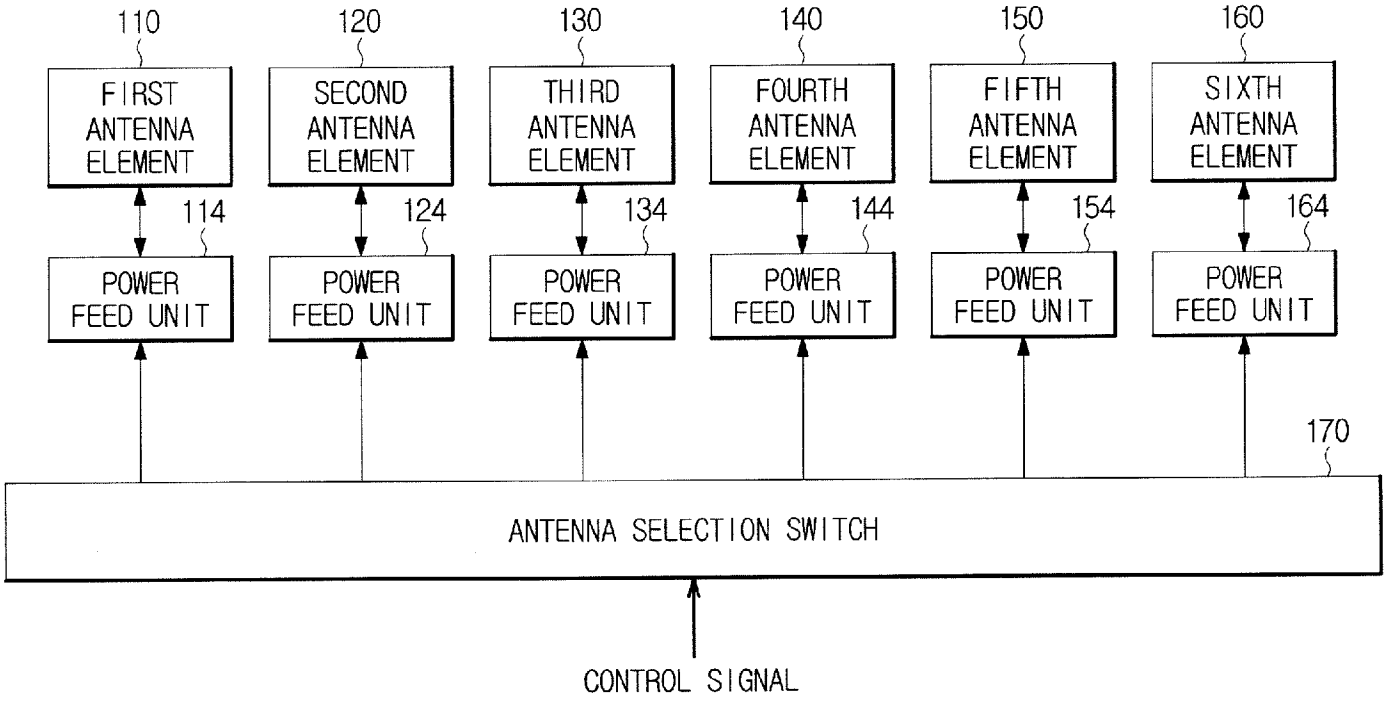
FIG. 11 is a diagram illustrating a switch capable of selecting the antenna element.

FIGS. 9 and 10 are diagrams illustrating a power feed structure supplying power to each antenna element, and FIG. 11 is a diagram illustrating a switch capable of selecting the antenna element. FIG. 9 is a plan view of the power feed unit as viewed from above, and FIG. 10 is a lateral view thereof as viewed from side.

The plurality of antenna elements 110, 120, 130, 140, 150, and 160 respectively have separate power feed units 114, 124, 134, 144, 154, and 164.

As shown in FIGS. 9 and 10, the power feed units 114, 124, 134, 144, 154, and 164 are extended and connected to a common ground unit of the antenna apparatus 100, so that the common ground unit may be formed on a substrate that constitutes a bottom of the antenna apparatus 100. The substrate constituting the bottom of the antenna apparatus 100 may be the first substrate 101, and it is possible to further provide a separate substrate under the first substrate 101 to constitute the bottom.

The antenna apparatus 100 may transmit the radio signal through the antenna element corresponding to a direction in which a communication target is located, wherein the radio signal may be transmitted in the desired direction by selecting the power feed unit of the corresponding antenna element. At this point, one power feed unit may be selected, or two or more power feed units may be selected depending on the number of communication targets.

For selecting the power feed unit corresponding to the desired direction, the antenna apparatus 100 may further include a switching unit, and the switching unit may include an antenna selection switch 170 as shown in FIG. 11. As an example, the antenna selection switch 170 may be implemented with a radio frequency (RF) switch.

The power feed unit 114 for supplying power to the first antenna element 110, the power feed unit 124 for supplying power to the second antenna element 120, the power feed unit 134 for supplying power to the third antenna element 130, and the power feed unit 144 for supplying power to the fourth antenna element 140 are connected to the antenna selection switch 170.

The antenna selection switch 170 may select at least one of the multiple power feed units 114, 124, 134, 144, 154, and 164 according to a control signal input and provide a signal to the selected power feed unit. In this form, selecting a power feed unit and providing a signal thereto will be referred to as a switching of the power feed unit.

The control signal input to the antenna selection switch 170 may be generated by an external control unit of the antenna apparatus 100 or by a control unit provided therein.

In the latter case, the control unit provided in the antenna apparatus 100 may control the antenna selection switch 170 according to a control signal input from an instrument (for example, a vehicle) on which the antenna apparatus 100 is mounted or generate a control signal based on its own judgment.

When the control unit is included in the antenna apparatus 100, it is possible that the control unit of the antenna apparatus 100 performs a part or all of the operations of the control unit of a vehicle to be described below for controlling the antenna apparatus 100.

The antenna selection switch 170 may be formed at the common ground unit to which the multiple power feed units are grounded.

Figure 12:
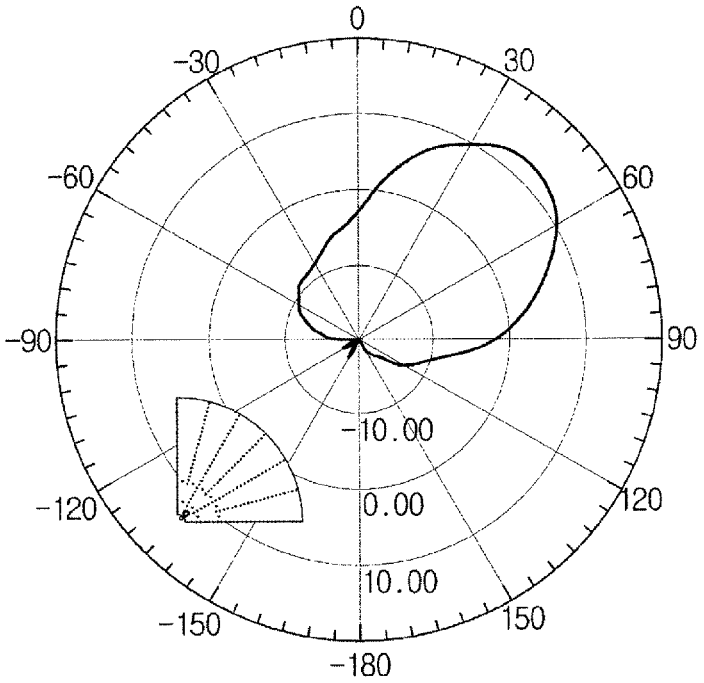
FIG. 12 is a diagram illustrating a radiation pattern of the single antenna element.
Figure 13:
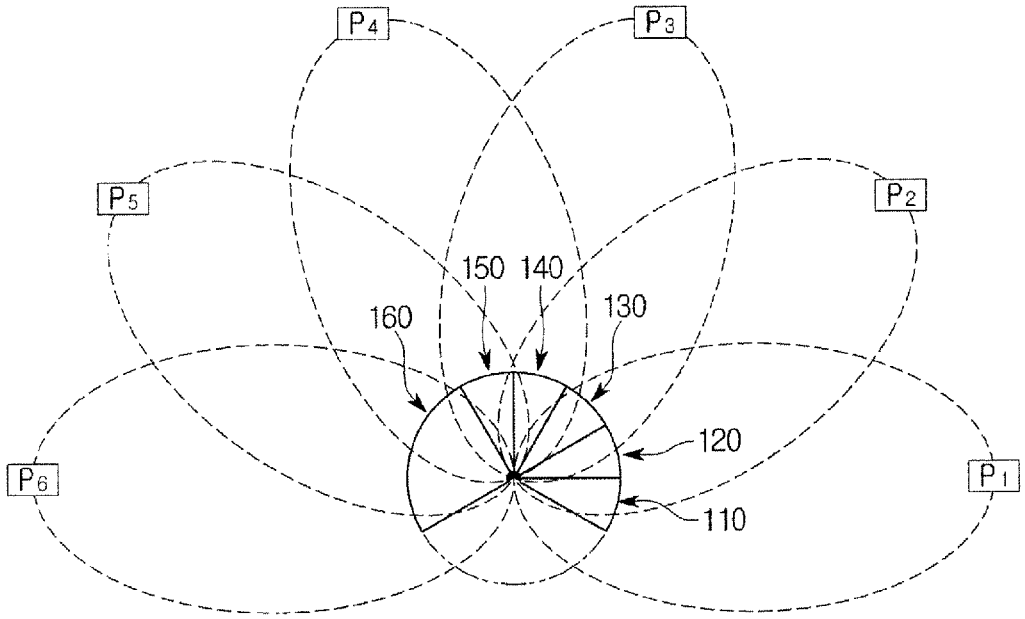
FIG. 13 is a diagram illustrating directivity of the antenna apparatus.

FIG. 12 is a diagram illustrating a radiation pattern of the single antenna element, and FIG. 13 is a diagram illustrating directivity of the antenna apparatus.

As shown in FIG. 12, it can be seen that a size of a side lobe appears very small on the radiation pattern of the single antenna element. That is because the radio signals having the same amplitude and phase are provided to the multiple waveguides constituting the antenna elements.

Also, it can be seen that a main lobe appears in a direction into which the radiation slots of the antenna elements are formed to radiate. Therefore, the antenna apparatus 100 according to one form of the present invention has a superior radiation efficiency and directivity.

When the multiple antenna elements 110, 120, 130, 140, 150, and 160 having such a radiation pattern are respectively shifted by a predetermined angle to be stacked, as shown in FIG. 13, the antenna apparatus 100 having beam patterns $P_1$, $P_2$, $P_3$, $P_4$, $P_5$, and $P_6$ toward various directions may be implemented.

Since each antenna element has a directivity toward a predetermined direction, the radio signal may be radiated toward a desired direction by selecting and feeding an antenna element corresponding to a desired radiation direction.

At this point, one antenna element may be selected, or two or more antenna elements may be simultaneously selected depending on the number and position of a communication target.

Figure 14:
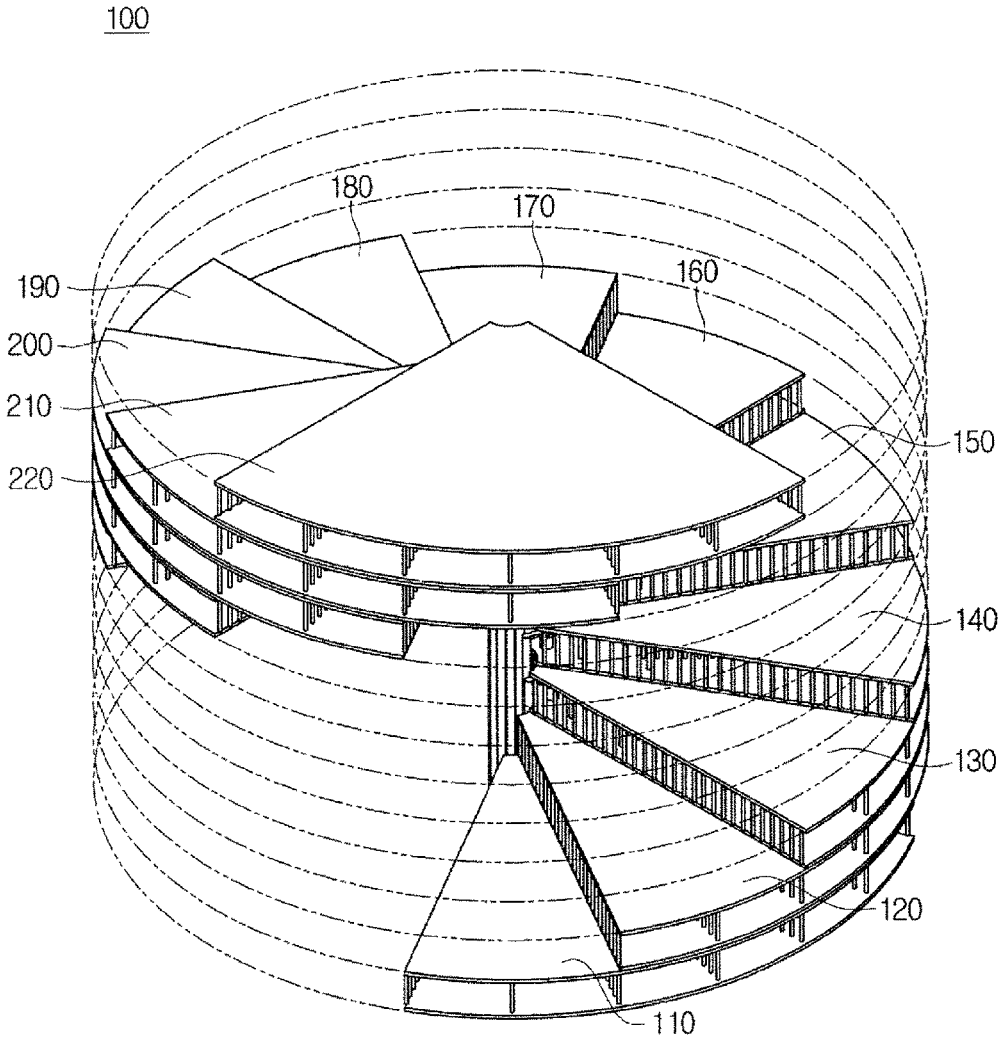
FIGS. 14 and 15 are diagrams illustrating another structure of the antenna apparatus.
Figure 15:
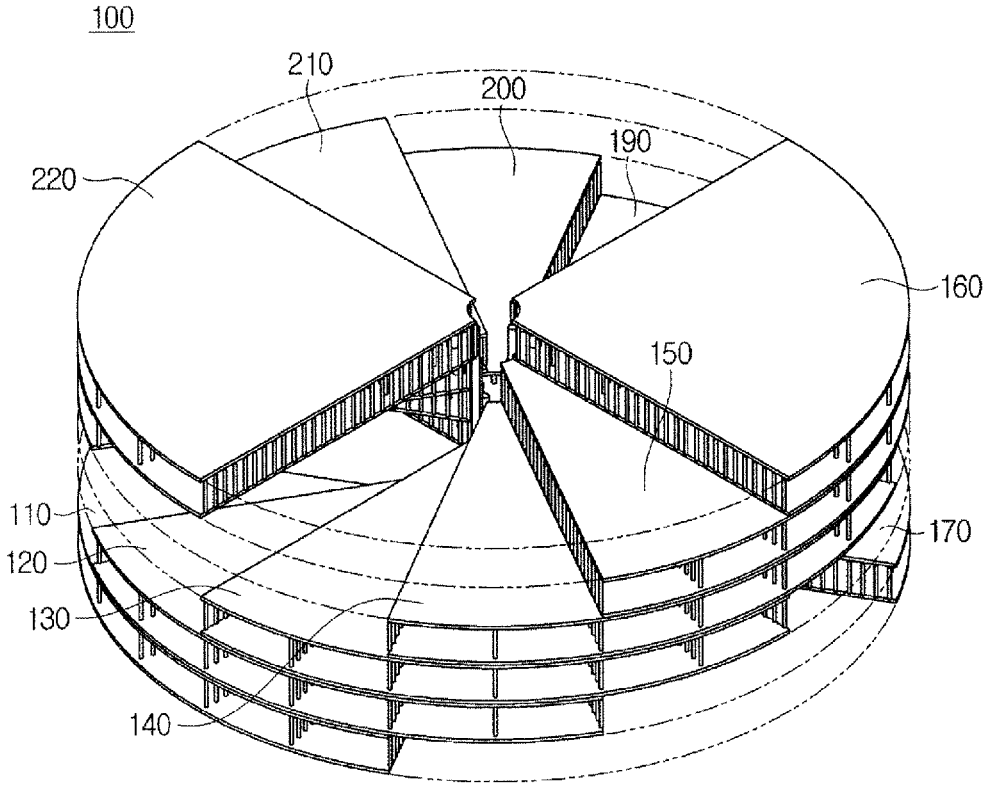

FIGS. 14 and 15 are diagrams illustrating another structure of the antenna apparatus according to one form of the present invention.

In the aforementioned form, the structure in which six antenna elements 110, 120, 130, 140, 150, and 160 are stacked one per layer in the z-axis direction is described as the example, but the number, stack structure, shift angle, and the like of the antenna element are not limited by the aforementioned examples and may be modified.

In another example, as shown in FIG. 14, it is possible to implement a 12-layer structure of which twelve antenna elements 110 to 220 are stacked one per layer. A 30 degree shift angle between antenna elements adjacent in the z-axis direction means it is possible to cover a range of 360 degrees in the horizontal direction.

In still another example, as shown in FIG. 15, it is possible to implement a 6-layer structure out of the twelve antenna elements 110 to 220, in which two antenna elements are stacked per layer. In this case, by also designing a shift angle between antenna elements adjacent in the z-axis direction to be 30 degrees and additionally designing a shift angle between two antenna elements in the same layer to be 180 degrees for facing opposite directions, it is possible to cover a range of 360 degrees in the horizontal direction.

Meanwhile, the antenna apparatus 100 may be mounted on a vehicle to transmit and receive a radio signal to and from an external terminal or server of the vehicle or other vehicles.

Hereinafter, an form of a vehicle having the antenna apparatus 100 mounted will be described.

A radio signal being transmitted and received by the antenna may be a signal according to a second generation (2G) communication method such as a time division multiple access (TDMA), a code division multiple access (CDMA), and the like, a third generation (3G) communication method such as a wide CDMA (WCDMA), a CDMA 2000, a wireless broadband (Wibro), a world interoperability for microwave access (WiMAX), and the like, a fourth generation (4G) communication method such as a long term evolution (LTE), a wireless broadband evolution, and the like, and a fifth generation (5G) communication method.

Exemplary forms will be described in detail below assuming that the antenna transmits and receives a radio signal according to the 5G communication method.

Figure 16:
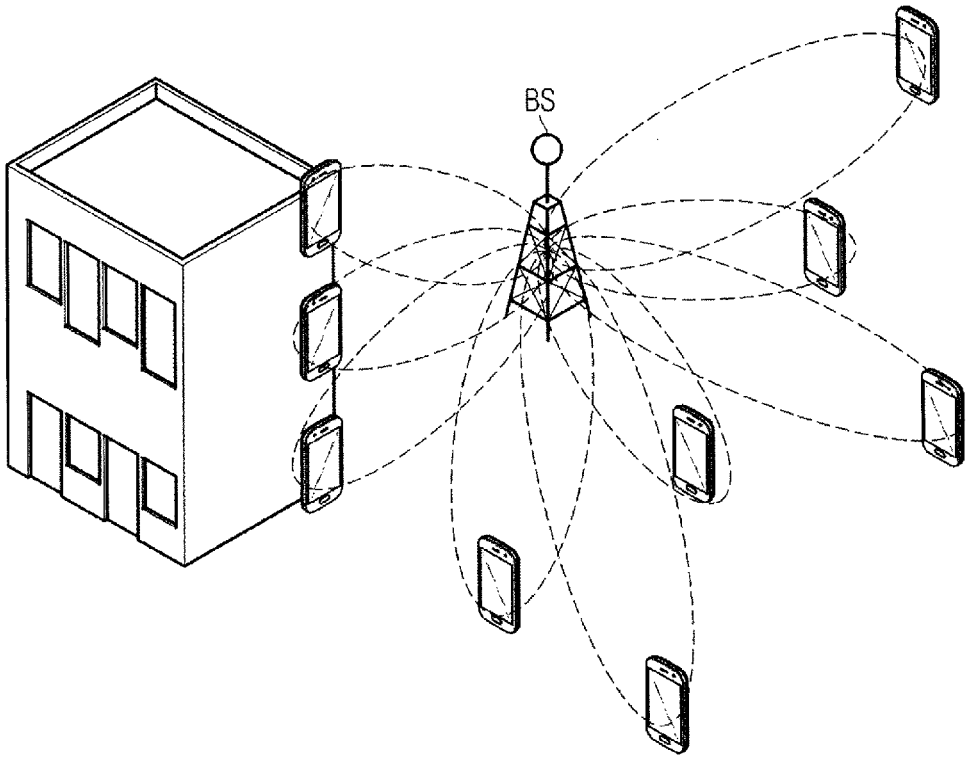
FIG. 16 is a diagram illustrating a large-scale antenna system of a base station according to a fifth generation (5G) communication method.
Figure 17:
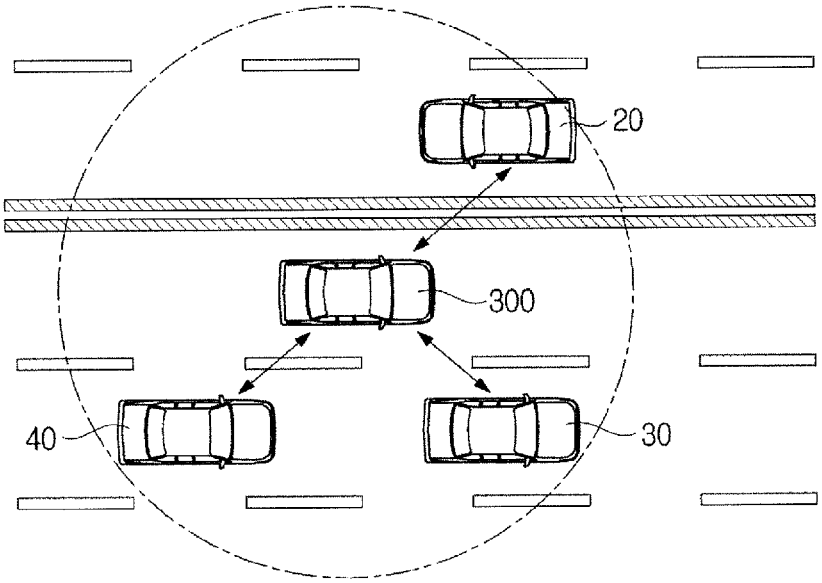
FIG. 17 is a diagram illustrating a vehicle communicating with peripheral vehicles.

FIG. 16 is a diagram illustrating a large-scale antenna system of a base station according to the 5G communication method, and FIG. 17 is a diagram illustrating a vehicle communicating with peripheral vehicles.

In the 5G communication method, the large-scale antenna system may be employed. The large-scale antenna system represents a system capable of covering an ultra-high frequency by using over tens of antennas and of transmitting and receiving simultaneously large amounts of data through multiple access. In particular, the large-scale antenna system may perform a massive data transmission as well as extend the available area of the 5G communication network by adjusting an array of antenna elements to transmit and receive radio signals farther in a specific direction.

With reference to FIG. 16, the base station BS may simultaneously transmit and receive data to and from numerous equipment through the large-scale antenna system. Also, the large-scale antenna system minimizes electromagnetic waves being drained into directions other than the transmission direction to reduce noise, thereby promoting the improvement of transmission quality as well as the reduction of power.

Also, unlike a general communication method of modulating a transmission signal through an orthogonal frequency division multiplexing (OFDM), the 5G communication method transmits a radio signal modulated through a non-orthogonal multiplexing access (NOMA), so that multiple access of more equipment and a simultaneous massive data transmission and reception are possible.

For example, the 5G communication method may provide a transmission speed of 1 gigabit per second (Gbps) at maximum. Through a massive transmission, the 5G communication method may support an immersive communication such as an ultra-high definition (UHD), a 3-dimension (3D) hologram or the like, which requires the massive transmission. Accordingly, through the 5G communication method, a user may more quickly transmit and receive ultra-high capacity data which may be more delicate and more immersive.

Also, the 5G communication method may process in real time at a maximum response speed of 1 millisecond (ms) or less. Accordingly, the 5G communication method may support a real time service that responds well in advance of the user response.

For example, when a communication module realizing the 5G communication method is mounted on a vehicle, the vehicle itself may be a communication hub that transmits and receives data. Accordingly, a vehicle communicating with external equipment may provide an autonomous driving system as well as various remote controls by receiving sensor information from a variety of equipment while driving to process the received sensor information in real time.

The 5G communication method may use a millimeter wave band. For example, the 5G communication method may use a frequency band of 28 GHz. A longer wavelength of a radio signal means a larger size of the antenna apparatus 100. That is, a higher frequency of a radio signal means a smaller size of the antenna apparatus 100. Therefore, when used in 5G communication, the antenna apparatus 100 may be implemented as a micro and low profile.

Through the real-time process and massive transmission provided by 5G communication, a vehicle 300 may provide a big data service to passengers therein. For example, the vehicle may analyze various information on the web, social network service (SNS), and the like to provide customized information suitable for situation of the passengers. As an example, the vehicle collects information such as famous restaurants, attractions, and the like existing in the surroundings of a travel route through a big data mining and provide the collected information in real time, so that the passengers may immediately check the various information related to the surroundings of a travel route.

Also, a network of 5G communication may perform a relay transmission of a radio signal through a multi-hop method. For example, the vehicle located within a network of the base station BS may perform a relay transmission of a radio signal to be transmitted by other vehicles or equipment positioned outside of the network of the base station BS to provide the radio signal to the base station BS. Accordingly, it is possible to expand areas in which the 5G communication network is supported as well as to solve a buffering problem that occurs when the number of users within a cell are increased.

Meanwhile, the 5G communication method may provide a device-to-device (D2D) communication applicable to vehicles, communication equipment, and the like. Direct D2D communication stands for a communication in which devices directly transmit and receive signals without a base station. When the direct D2D communication method is employed, there is no need to transmit and receive a radio signal through a base station, and a direct transmission and reception of the radio signal occurs between devices, so that unnecessary energy consumption may be reduced.

In this case, as shown in FIG. 17, through the 5G communication method, the vehicle 300 may process sensor information in real time together with peripheral vehicles 20, 30, and 40 existing in the surroundings of the vehicle 300 to provide collision generation possibility information to users in real time as well as traffic situation information to occur on a travel route in real time.

Figure 18:
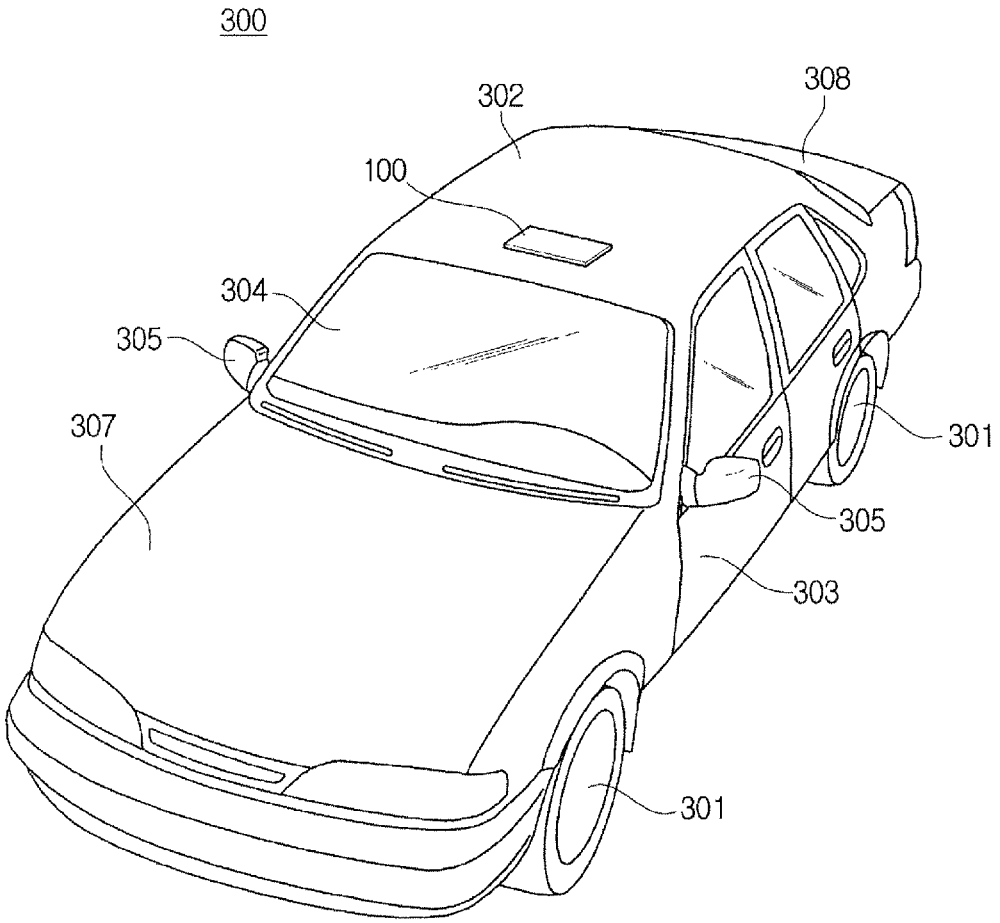
FIGS. 18 and 19 are diagrams illustrating an exterior of the vehicle.
Figure 19:
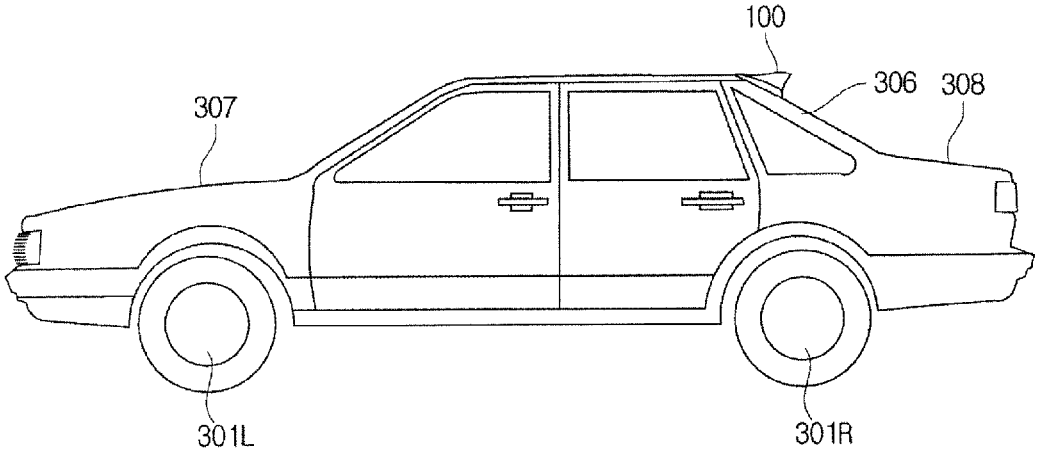

FIGS. 18 and 19 are diagrams illustrating an exterior of a vehicle.

As shown in FIGS. 18 and 19, the vehicle 300 includes wheels 301 moving the vehicle 300, a body 302 forming the exterior of the vehicle 300, a drivetrain (not shown) rotating the wheels 301, doors 303 shielding an interior from the outside, a front glass 304 providing a view in the forward direction of the vehicle to a driver inside thereof, and side mirrors 305 providing a view in the rear direction of the vehicle to the driver.

The drivetrain provided within an engine hood 307 provides rotary power to the wheels 301 in order to move the vehicle in a forward or backward direction.

Such a drivetrain may employ an engine generating rotary power by burning fossil fuel or a motor generating rotary power by receiving electric power supplied from an electric condenser (not shown).

The doors 303 are rotatably provided on the left and right sides of the body 302 to enable the driver to enter the vehicle 300 when opened and shield the interior of the vehicle 300 from the outside thereof when closed.

The front glass 304 is provided in the front portion of the body 302 to enable the driver to acquire visual information from the front direction of the vehicle 300, and it is also referred to as a windshield glass.

Also, the side mirrors 305 enable the driver in the vehicle 300 to acquire visual information of the side and rear of the body 302.

The antenna apparatus 100 may be mounted outside of the vehicle 300. Since the antenna apparatus 100 is implemented as a micro type and low profile, as shown in FIG. 18, it may be mounted on top of a roof, the engine hood 307, or the like, but not limited thereto.

Also, as the example shown in FIG. 19, the antenna apparatus 100 may be implemented integrated with a shark fin antenna mounted on an upper portion of a rear glass 306.

Further, two or more antenna apparatuses 100 may be mounted on the vehicle 300. For example, the antenna apparatus 100 covering a front range of 240 degrees may be mounted on top of the engine hood 307, and the antenna apparatus 100 covering a rear range of 240 degrees may be mounted on top of a trunk 308 or the shark fin antenna.

There is no limitation on a position or a number of the antenna apparatuses 100, and an appropriate number and positions, and a radiation range of the antenna apparatus 100 may be determined by taking into consideration of the use of the antenna apparatus 100, a design of the vehicle 300, a straight-line propagation of the radio signal, and the like.

Figure 20:
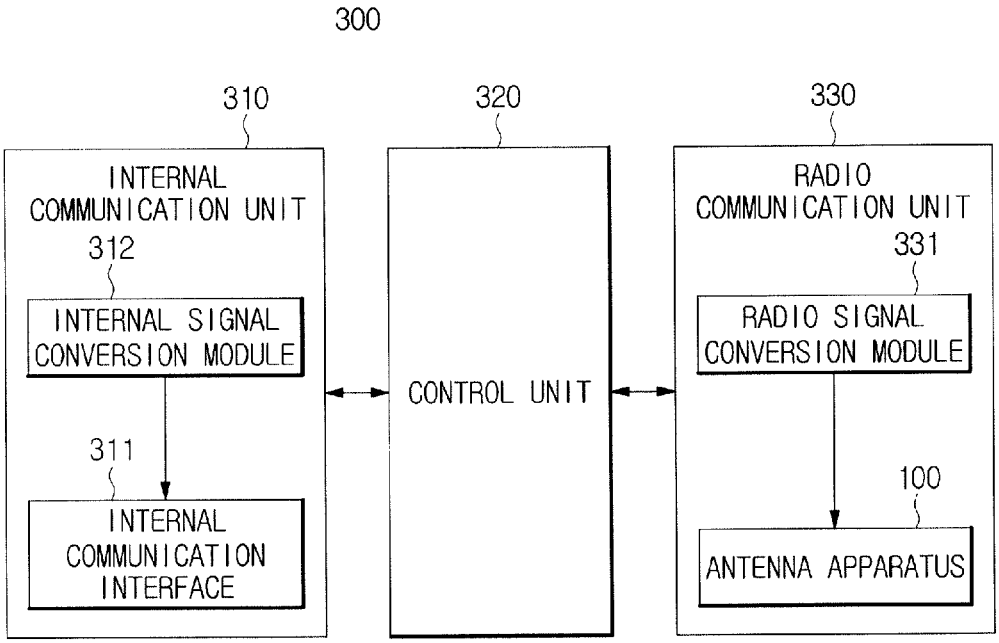
FIG. 20 is a control block diagram of the vehicle.
Figure 21:
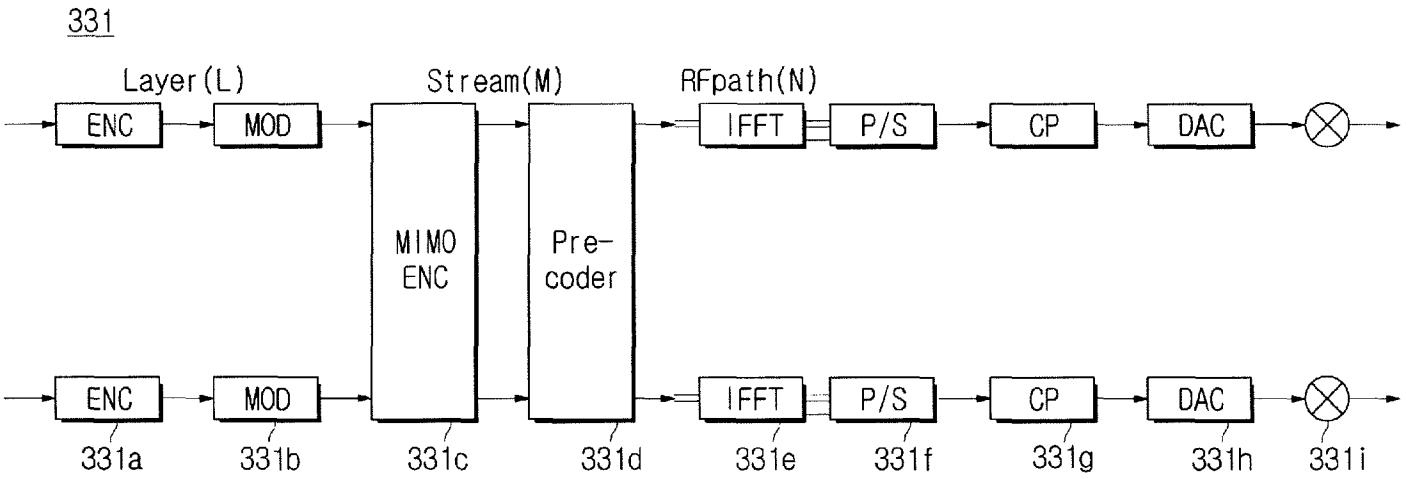
FIG. 21 is a diagram illustrating a configuration of a transceiver included in a communication unit.
Figure 22:
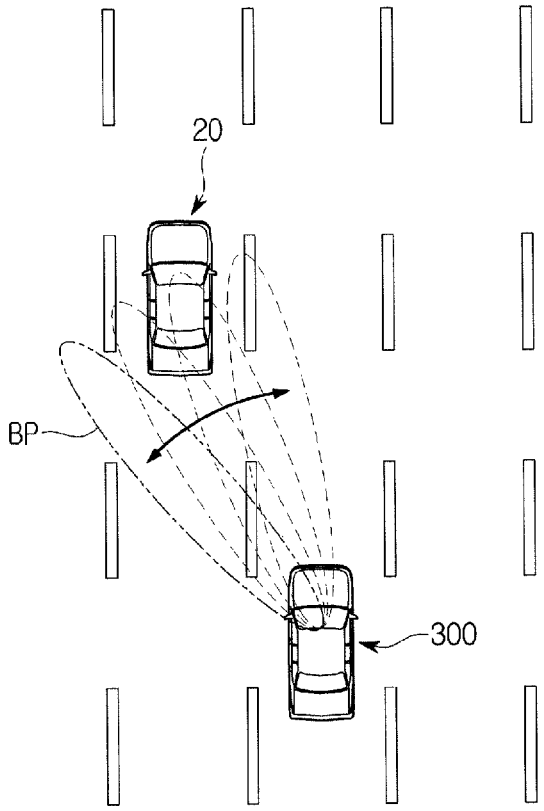
FIGS. 22 to 25 are diagrams illustrating the example of a beam pattern that is formed by the vehicle in order to communicate with the peripheral vehicles.

FIG. 20 is a control block diagram of the vehicle, and FIG. 21 is a diagram illustrating a configuration of a radio signal conversion module included in a communication unit. The control block diagram of FIG. 20 shows a configuration relating to a communication of the vehicle, and configurations relating to other operations such as driving, a control of the interior environment of the vehicle, and the like are omitted. Therefore, it should be noted that components not shown in FIG. 20 do not indicate exclusion from the vehicle 300.

With reference to FIG. 20, the vehicle 300 may include an internal communication unit 310 communicating with a variety of electronic equipment in the vehicle 300 through a vehicle communication network therein, a radio communication unit 330 communicating with equipment, base stations, servers outside of the vehicle 300, and/or other vehicles, and a control unit 320 controlling the internal communication unit 310 and the radio communication unit 330.

The internal communication unit 310 may include an internal communication interface 311 connected to the vehicle communication network and an internal signal conversion module 312 modulating and demodulating a signal.

The internal communication interface 311 may receive radio signals transmitted from a variety of electronic equipment in the vehicle 300 through the vehicle communication network and transmit radio signals to the variety of electronic equipment in the vehicle 300 through the vehicle communication network. Herein, the radio signals stand for signals which are transmitted and received through the vehicle communication network.

Such an internal communication interface 311 may include a communication port and a transceiver transmitting and receiving signals.

Under the control of the control unit 320 to be described in below, the internal signal conversion module 312 may demodulate a communication signal received through the internal communication interface 311 into a control signal and modulate a control signal output from the control unit 320 into an analog communication signal to be transmitted through the internal communication interface 311.

The internal signal conversion module 312 modulates the control signal output from the control unit 320 into a communication signal according to a communication protocol of the vehicle network and demodulates the communication signal according to the communication protocol of the vehicle network into a control signal recognizable by the control unit 320.

Such an internal signal conversion module 312 may include a memory storing a program and data for performing the modulation/demodulation of the communication signal and a processor performing the modulation/demodulation of the communication signal according to the program and data stored in the memory.

The control unit 320 controls operations of the internal signal conversion module 312 and the internal communication interface 311. For example, when transmitting a communication signal, the control unit 320 determines whether or not the communication network is occupied by other electronic equipment through the internal communication interface 311 and then, when the communication network is not occupied, controls the internal communication interface 311 and the internal signal conversion module 312 to output the communication signal. Also, when receiving a communication signal, the control unit 320 controls the internal communication interface 311 and the internal signal conversion module 312 to demodulate the communication signal received through the internal communication interface 311.

Such a control unit 320 may include a memory storing a program and data for controlling the internal signal conversion module 312 and the internal communication interface 311 and a processor generating a control signal according to the program and data stored in the memory.

The radio communication unit 330 may include a radio signal conversion module 331 modulating and demodulating a signal and the antenna apparatus 100 transmitting the modulated signal to the outside and receiving a signal therefrom.

The radio signal conversion module 331 performs functions of a receiver demodulating a radio signal received by the antenna apparatus 100 and a transmitter modulating the control signal output from the control unit 320 into a radio signal to be transmitted to the outside, and thus it may be referred to as a transceiver.

The radio signal is sent by superposing a signal onto a carrier wave of a high frequency (for example, about 28 GHz in case of the 5G communication method). For this purpose, the radio signal conversion module 331 may generate a radio signal by modulating a carrier wave of a high frequency (for example, about 28 GHz in case of the 5G communication method) according to the control signal output from the control unit 320 and restore a signal by demodulating a radio signal received by the antenna apparatus 100.

For example, as shown in FIG. 21, the radio signal conversion module 331 may include an encoder (ENC) 331*a*, a modulator (MOD) 331*b*, a multiple input multiple output encoder (MIMO ENC) 331*c*, a pre-coder 331*d*, an inverse fast Fourier transformer (IFFT) 331*e*, a parallel-to-serial (P/S) converter 331*f*, a cyclic prefix (CP) inserter 331*g*, a digital-to-analog converter (DAC) 331*h*, and a frequency converter 331*i*.

A number L of control signals are input into the MIMO ENC 331*c* via the ENC 331*a* and the MOD 331*b*. A number M of streams output from the MIMO ENC 331*c* are pre-coded by the pre-coder 331*d* to be converted into a number N of pre-coded signals. The pre-coded signals are output as analog signals via the IFFT 331*e*, the P/S converter 331*f*, the CP inserter 331*g*, and the DAC 331*h*. The analog signals output from the DAC 331*h* are converted into a radio frequency (RF) band through the frequency converter 331*i*.

An electrical signal of voltage/current output from the radio signal conversion module 331 are converted into a radio signal at the antenna apparatus 100 to be radiated into outside free space.

Such a radio signal conversion module 331 may include a memory storing a program and data for performing the modulation/demodulation of a communication signal and a processor performing the modulation/demodulation of the communication signal according to the program and data stored in the memory.

However, a configuration of the radio signal conversion module 331 shown in FIG. 21 is merely an example and not limited thereto, so that other configurations may be implemented.

The vehicle 300 may transmit and receive real-time traffic information, accident information, status information of the vehicle, and the like, by communicating with an outside server or a control center through the antenna apparatus 100. Also, it is possible to perform an adaptive management with respect to road conditions while transmitting and receiving sensor information measured by sensors provided on each vehicle or to collect information regarding an accident when an accident occurs, through communication with other vehicles. Herein, the sensor provided on each vehicle may include at least one of an image sensor, an acceleration sensor, a collision sensor, a gyro sensor, a proximity sensor, a steering angle sensor, and a speed sensor.

Hereinafter, an form in which the vehicle 300 according to one form communicates with peripheral vehicles to transmit and receive signals will be described.

FIGS. 22 to 25 are diagrams illustrating examples of beam patterns formed by the vehicle in order to communicate with peripheral vehicles.

In order to transmit a signal from the vehicle 300 to the peripheral vehicles, a position of a communication target vehicle needs to be determined. As an example shown in FIG. 22, a beam scanning may be performed such that after beam patterns BP are formed and radiated in various directions, a peripheral vehicle 20 is determined to be located in a direction in which a response returns.

In particular, the vehicle 300 transmits an omnidirectional request signal or a request signal in various directions through the antenna apparatus 100 and, when an ack signal returns from the peripheral vehicle 20 located in the surrounding of the vehicle 300, it may be determined that the peripheral vehicle 20 is located in a direction in which the ack signal returns. At this point, the peripheral vehicle 20 may transmit the ack signal with global positioning system (GPS) information included. In this case, even when multiple peripheral vehicles are overlapped and located in the same direction on the center of the vehicle 300, it is possible to discriminate each one from the multiple peripheral vehicles.

In order to form beam patterns BP in various directions, a part or all of the plurality of antenna elements may be sequentially selected. Herein, selecting the antenna element represents switching a power feed unit of the selected antenna element and feeding power thereto.

The selection of the antenna element may be performed by the switching unit, and the switching unit may perform a switching operation according to the control signal of the control unit 320.

Figure 23:
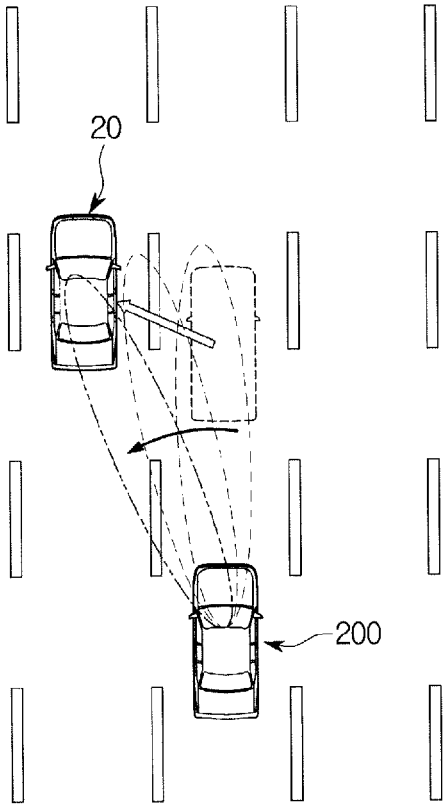
Figure 24:
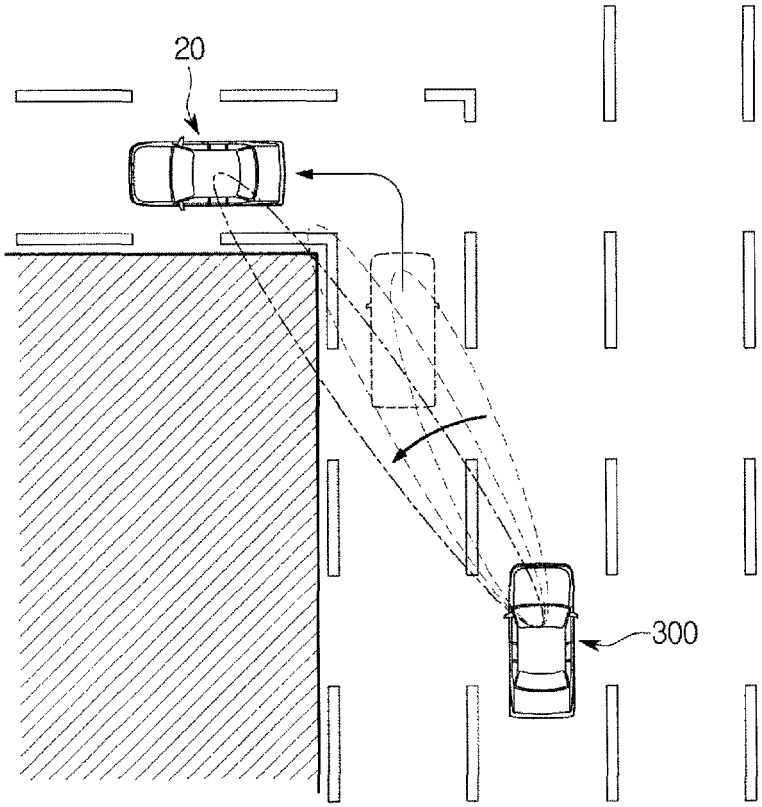

Also, when, after establishing a communication with the peripheral vehicle 20, the peripheral vehicle 20 or the vehicle 300 moves and thus vary a relative position thereof, as shown in FIGS. 23 and 24, a beam tracking may be performed according to a movement direction of the peripheral vehicle 20 or the vehicle 300. Herein, the beam tracking represents switching the beam patterns according to the movement or the variation of the relative position of a communication target. Switching beam patterns may be performed through the switching of the power feed unit.

Figure 25:
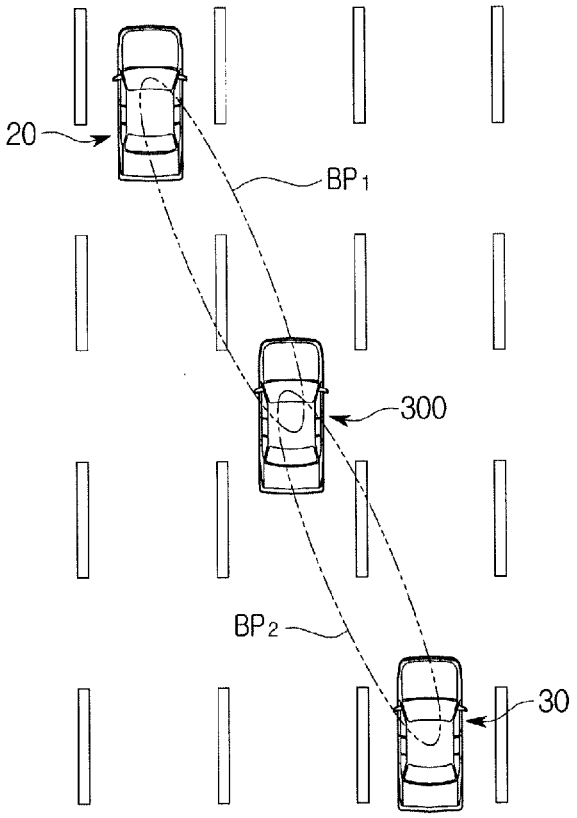

Also, when the number of peripheral vehicles 20 and 30 that are communication targets is two or more, as shown in FIG. 25, an antenna element corresponding to a position of each communication target is selected so that it is possible to simultaneously communicate with two or more peripheral vehicles.

With forms of the antenna apparatus, without employing a complicated feed structure or a structure for mechanically rotating the antenna, beam patterns in desired directions may be formed by selectively feeding the antenna element.

Also, a coverage range may be controlled as desired by adjusting the number of antenna elements being stacked.

Such an antenna may be implemented as a low profile and micro type. Therefore, when such an antenna is employed to the vehicle to perform 5G communication, the position of a communication target may be easily determined by using a beam scanning through the selective switching of the antenna elements.

Also, even if the communication target vehicle moves, the beam pattern may track the movement of the communication target vehicle by switching the antenna elements.

Although forms have been described in specific examples and drawings given as described above, various modifications, additions and substitutions are possible by those of ordinary skill in the art from the description herein. For example, the described techniques may be performed in different order from the above-described methods, and/or the above-described systems, structures, devices, and components such as a circuit may be coupled to or combined with other form different from the above-described methods, or replaced with other components or equivalents to result in an acceptable outcome.

Therefore, other implementations, other forms and equivalents as well as claims are within the scope of the claims to be described later.

Also, the forms described therein and the configurations shown in the accompanying drawings are merely preferred forms of the present disclosure, and various equivalents and modifications that can be made thereto may exist at the filing time of the present application.

Further, the terms as used herein are intended to illustrate the forms and are not intended to limit the invention. As described herein, expressions in the singular should be understood to include a plural meaning unless there is a clearly different meaning from the context. The terms of "comprise", "include" and/or "have", and the like specify the presence of stated features, numbers, steps, operations, elements, parts, and/or a combination thereof, but do not preclude the presence or addition of one or more other features, numbers, steps, operations, elements, parts, and/or a combination thereof.

Also, as used herein, while the terms including ordinal numbers such as "first", "second", and the like are used to describe various components, the above components shall not be restricted to the above terms, and these terms are only used to distinguish one element from another.

The invention claimed is:

1. An antenna apparatus, comprising:

a power feed unit;

a waveguide through which a radio signal provided from the power feed unit propagates; and a plurality of antenna elements including radiation slots from which the radio signal propagated through the waveguide is radiated, wherein the antenna elements of the plurality of antenna elements are shifted by a predetermined angle and stacked, and wherein the plurality of antenna elements is formed by multiple substrates stacked on top of each other in a relative direction.

2. The antenna apparatus according to claim 1, further comprising a switching unit configured to switch at least one of the power feed units included in the plurality of antenna elements in order to select at least one of the plurality of antenna elements.

3. The antenna apparatus according to claim 1, wherein the antenna element of the plurality of antenna elements includes:

an upper plate;

a lower plate; and n partition walls (n is an integer equal to or greater than 2) which is formed between the upper and lower plates to form n−1 number of waveguides.

4. The antenna apparatus according to claim 3, wherein the upper plate and the lower plate of the multiple substrates are each formed in predetermined regions of two substrates adjacent to each other.

5. The antenna apparatus according to claim 3, wherein the partition wall is formed by a plurality of pins whose adjacent pins are spaced at a distance below a critical distance, and the plurality of pins are inserted into the upper plate and the lower plate.

6. The antenna apparatus according to claim 3, wherein the n−1 number of waveguides distribute the radio signal provided from the power feed unit in the same phase and amplitude.

7. The antenna apparatus according to claim 6, wherein n−1 number of inductive posts are arranged between the power feed units and the n−1 number of waveguides.

8. The antenna apparatus according to claim 1, further comprising:

a common ground unit to which the power feed units included in the plurality of antenna elements are connected.

9. The antenna apparatus according to claim 1, wherein the antenna elements of the plurality of antenna elements are stacked one per layer.

10. The antenna apparatus according to claim 1, wherein the antenna elements of the plurality of antenna elements are stacked two or more per layer.

11. A vehicle comprising:

an antenna apparatus on the vehicle, wherein the antenna apparatus includes:

a power feed unit;

a waveguide through which a radio signal provided from the power feed unit propagates; and a plurality of antenna elements including radiation slots from which the radio signal propagated through the waveguide is radiated and configured to be shifted by a predetermined angle and stacked, and wherein the plurality of antenna elements is formed by multiple substrates stacked on top of each other in a relative direction.

12. The vehicle according to claim 11, wherein the antenna apparatus further includes a switching unit configured to switch at least one of the power feed units included in the plurality of antenna elements.

13. The vehicle according to claim 11, wherein the antenna element of the plurality of antenna elements includes:

an upper plate;

a lower plate; and n partition walls (n is an integer equal to or greater than 2) which is formed between the upper and lower plates to form n−1 number of the waveguides.

14. The vehicle according to claim 13, wherein the upper plate and the lower plate of the multiple substrates are each formed in a predetermined region of two substrates adjacent to each other.

15. The vehicle according to claim 13, wherein the partition wall is formed by a plurality of pins whose adjacent pins are spaced at a distance below a critical distance, and a plurality of fins are inserted into the upper plate and the lower plate.

16. The vehicle according to claim 13, wherein the n−1 number of waveguides distribute the radio signal provided from the power feed unit in the same phase and amplitude.

17. The vehicle according to claim 16, wherein n−1 number of inductive posts are arranged between the power feed units and the n−1 number of waveguides.

18. The vehicle according to claim 11, further comprising:

a common ground unit to which the power feed units included in the plurality of antenna elements are connected.

19. The vehicle according to claim 12, wherein the switching unit sequentially switches the power feed units in order to determine a position of a communication target.

20. The vehicle according to claim 12, wherein the switching unit switches the power feed unit of the antenna element corresponding to a position of a communication target.

21. The vehicle according to claim 19, wherein the switching unit performs a beam tracking by switching the power feed unit according to a movement of the communication target when the communication target moves.

22. The vehicle according to claim 19, wherein the switching unit performs a beam tracking by switching the power feed unit according to a movement of the vehicle when the vehicle moves.

* * * * *